US010073393B2

(12) United States Patent
Minemura et al.

(10) Patent No.: US 10,073,393 B2
(45) Date of Patent: Sep. 11, 2018

(54) FIXING DEVICE AND IMAGE FORMING APPARATUS

(71) Applicant: KONICA MINOLTA, INC., Chiyoda-ku, Tokyo (JP)

(72) Inventors: Taisuke Minemura, Okazaki (JP); Shoichi Yoshikawa, Okazaki (JP); Yoshiyuki Toso, Toyokawa (JP); Masahiro Yamaguchi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/622,149

(22) Filed: Jun. 14, 2017

(65) Prior Publication Data

US 2017/0364006 A1 Dec. 21, 2017

(30) Foreign Application Priority Data

Jun. 21, 2016 (JP) ..... 2016-122548

(51) Int. Cl.
*G03G 15/00* (2006.01)
*G03G 15/20* (2006.01)

(52) U.S. Cl.
CPC ..... *G03G 15/2067* (2013.01); *G03G 15/2025* (2013.01); *G03G 15/2089* (2013.01); *G03G 15/5054* (2013.01); *G03G 2215/00156* (2013.01); *G03G 2215/2009* (2013.01)

(58) Field of Classification Search
CPC ... G03G 2215/0145; G03G 2215/2035; G03G 15/2075; G03G 15/2025
See application file for complete search history.

(56) References Cited

U.S. PATENT DOCUMENTS

| | | | | |
|---|---|---|---|---|
| 7,986,909 | B2 * | 7/2011 | Nanba | G03G 15/2025 399/329 |
| 2012/0201558 | A1 * | 8/2012 | Watanabe | G03G 15/2078 399/69 |
| 2014/0241748 | A1 * | 8/2014 | Proffitt | G03G 15/2025 399/69 |
| 2014/0241763 | A1 * | 8/2014 | Proffitt | G03G 15/2025 399/325 |
| 2014/0241769 | A1 * | 8/2014 | Tanto | G03G 15/2025 399/329 |

FOREIGN PATENT DOCUMENTS

| | | | |
|---|---|---|---|
| JP | 2013068888 | A | 4/2013 |
| JP | 2014174434 | A | 9/2014 |

* cited by examiner

*Primary Examiner* — Clayton E Laballe
*Assistant Examiner* — Ruifeng Pu
(74) *Attorney, Agent, or Firm* — Holtz Holtz & Volek PC

(57) ABSTRACT

A fixing device includes: a fixing belt with no ends configured to stretch rotatably; a heating unit configured to heat the fixing belt; a fixing member disposed outside the fixing belt and configured to be in contact with the fixing belt by pressurizing; a pressing member disposed inside the fixing belt and configured to press the fixing member with the fixing belt involved; and a lubricant supply unit configured to supply a lubricant to the inner periphery of the fixing belt so as to supply the lubricant between the pressing member and the fixing belt, wherein the lubricant supply unit is disposed inside the fixing belt, configured to hold the lubricant, and includes a holding unit provided with a lubricant ejection port having a longitudinal shape and extending along a width direction of the fixing belt.

18 Claims, 17 Drawing Sheets

FIXING DEVICE AND IMAGE FORMING APPARATUS

The entire disclosure of Japanese Patent Application No. 2016-122548 filed on Jun. 21, 2016 including description, claims, drawings, and abstract are incorporated herein by reference in its entirety.

BACKGROUND OF THE INVENTION

Field of the Invention

The present invention relates to a fixing device and an image forming apparatus.

Description of the Related Art

In recent years, what is called a belt-pad type image forming apparatus has been employed in the related art. In the belt-pad type image forming apparatus, a nip portion is formed by involving a fixing belt and bringing a pad (pressing member) disposed inside the fixing belt into contact with a pressurizing roller configured to pressurize.

In this fixing device, the fixing belt is driven to rotate with the pressurizing roller so as to fix unfixed toner on a sheet and convey the sheet to a sheet ejection tray. At that time, in order to smooth the rotation of the fixing belt, a lubricant is interposed between the inner periphery of the fixing belt and the pad so as to reduce sliding resistance.

However, compared to what is called a belt-roller type fixing device in which a roller instead of a pad is brought into contact with the inner periphery of a fixing belt, the belt-pad type fixing device has a disadvantageous short lifetime since the inner periphery of the fixing belt and the pad are slid, which exhausts the lubricant when being used for a long period.

Therefore, in the belt-pad type fixing device, it is necessary to prevent exhaustion of the lubricant in order to secure a long lifetime.

The following documents are examples of one disclosing a fixing device configured to supply a lubricant between a pad and the inner periphery of a fixing belt in order to prevent exhaustion of the lubricant: that is, JP 2014-174434 A, and JP 2013-68888 A.

In the fixing device disclosed in JP 2014-174434 A, a sheet-like sliding sheet containing a lubricant is mounted on a surface of a pressing member disposed in a fixing belt. The sliding sheet includes a fiber sheet and the like. This sliding sheet is provided with inclined creases for flowing the lubricant in one direction. Furthermore, a pipe that forms a circulation channel for circulating the lubricant is connected to one end and the other end of the sliding sheet. A container configured to accumulate the lubricant and provided outside the fixing device is connected to the pipe. The lubricant is pressed into the pipe from the container with a pump and is circulated within the circulation channel. The lubricant that has reached one end of the sliding sheet moves toward the other end of the sliding sheet along the creases and is introduced into the pipe connected to the other end.

In the fixing device disclosed in JP 2013-68888 A, a sliding sheet is interposed between a pressing member disposed in a fixing belt and the inner periphery of the fixing belt. The sliding sheet is conveyed in a reciprocating manner by a conveyance system. A moving direction of the sliding sheet differs between a driving mode and a cleaning mode. In the cleaning mode, a surface of the sliding sheet in a side close to the fixing belt is cleaned by a cleaning roller, and the cleaned surface is supplied with a lubricant by a lubricant supply roller. After the lubricant is supplied to the sliding sheet, the cleaning roller is separated from the sliding sheet, and the sliding sheet maintains in a standby condition until changing to the driving mode. In the driving mode, the sliding sheet moves toward a position between the pressing member and the fixing belt so that the lubricant is supplied between the fixing belt and the pressing member.

However, the fixing device disclosed in JP 2014-174434 A is configured to pour a lubricant with a pump, which may bring about pulsations in a circulation channel and uneven supply of the lubricant. Furthermore, such a fixing device requires a lubricant to fill inside a pipe so that an amount of the lubricant held in a container is increased. Still further, in a case of supplying semi-solid grease having high viscosity as a lubricant, a high pressure is required for moving the lubricant inside the thin pipe so that the pump grows in size. Therefore, the abovementioned fixing device is unsuitable when using a highly viscous lubricant.

In the fixing device disclosed in JP 2013-68888 A, a lubricant should be supplied to a sliding sheet over a range where the sliding sheet is to be conveyed, which increases an amount of the lubricant to be held by a lubricant supply roller. Furthermore, it is difficult for the sliding sheet to evenly hold the lubricant supplied over a wide range, which causes unevenness in an amount of the lubricant supplied between a pressing member and a fixing belt.

SUMMARY OF THE INVENTION

The present invention has been made in light of the abovementioned problems, and an object thereof is to provide a fixing device configured to moderate a lubricant to be supplied between a pressing member and a fixing belt while holding a small amount of a lubricant and to provide an image forming apparatus including the fixing device.

To achieve the abovementioned object, according to an aspect, a fixing device reflecting one aspect of the present invention comprises: a fixing belt with no ends configured to stretch rotatably; a heating unit configured to heat the fixing belt; a fixing member disposed outside the fixing belt and configured to be in contact with the fixing belt by pressurizing; a pressing member disposed inside the fixing belt and configured to press the fixing member with the fixing belt involved; and a lubricant supply unit configured to supply a lubricant to the inner periphery of the fixing belt so as to supply the lubricant between the pressing member and the fixing belt, wherein the lubricant supply unit is disposed inside the fixing belt, configured to hold the lubricant, and includes a holding unit provided with a lubricant ejection port having a longitudinal shape and extending along a width direction of the fixing belt.

According to the fixing device of the present invention, the holding unit is preferably provided to the fixing belt without being in contact with the fixing belt.

According to the fixing device of the present invention, in the width direction of the fixing belt, an amount of the lubricant to be ejected from a central part of the lubricant ejection port is preferably larger than an amount of the lubricant to be ejected from both ends of the lubricant ejection port.

According to the fixing device of the present invention, in the width direction of the fixing belt, an opening area in the central part of the lubricant ejection port is preferably larger than opening areas in both ends of the lubricant ejection port.

According to the fixing device of the present invention, in the width direction of the fixing belt, the lubricant ejection port preferably has an opening area equal from one end to the other end of the lubricant ejection port, and the lubricant is preferably held in the holding unit in such a manner that a height of the lubricant from an opening surface in a normal direction of the opening surface of the lubricant ejection port is set to be higher in the central part than in both ends of the lubricant in the width direction of the fixing belt.

According to the fixing device of the present invention, the lubricant supply unit is preferably stored inside the holding unit in a side opposite to a side where the lubricant ejection port is located with respect to the lubricant, and the lubricant supply unit is preferably configured to include a pushing member for pushing out the lubricant from the lubricant ejection port.

According to the fixing device of the present invention, the lubricant supply unit preferably includes an external force application system for applying an external force to the pushing member in order to press the pushing member toward the lubricant ejection port, and the external force application system is preferably stored inside the holding unit in a side opposite to a side where the lubricant is located with respect to the pushing member and is configured to include a biasing unit for biasing the pushing member toward the lubricant ejection port.

According to the fixing device of the present invention, the external force application system preferably further includes: a supporting unit movable with respect to the holding unit and configured to support the pushing member against the biasing force of the biasing unit; and an engagement unit configured to disengageably engage with the supporting unit and to immobilize the supporting unit while engaging with the supporting unit, and when the engagement unit is released from the supporting unit, the pushing member is preferably moved together with the supporting unit toward the lubricant ejection port by the biasing force of the biasing unit.

According to the fixing device of the present invention, the pushing member preferably has a first surface and a second surface opposing each other in a normal direction of an opening surface of the lubricant ejection port, and the pushing member is preferably disposed in a side close to the lubricant ejection port, being movable by pressure of gas supplied into the holding unit, the first surface is preferably disposed close to the lubricant ejection port, the second surface is preferably disposed far from the lubricant ejection port, and the holding unit preferably includes an introduction port into which gas is introduced and includes an accumulation chamber configured to communicate with the introduction port and to accumulate the gas introduced from the introduction port, and the accumulation chamber is preferably provided to a side opposite to a side where the lubricant is located with respect to the pushing member and has a bottom including the second surface.

According to the fixing device of the present invention, the lubricant supply unit preferably further includes a pipe for introducing gas to the introduction port, and the pipe preferably includes one end connected to the introduction port and the other end drawn out to the outside and connected to a source of gas supply.

According to the fixing device of the present invention, the first surface is preferably provided with an impregnated member impregnated with the lubricant, and the impregnated member preferably comes into contact with the inner periphery of the fixing belt after the pushing member moves toward the lubricant ejection port and pushes out the lubricant.

According to the fixing device of the present invention, the fixing device preferably further comprises a decompressing device configured to decompress the accumulation chamber.

According to the fixing device of the present invention, the accumulation chamber is preferably in a state of decompression before the lubricant is ejected from the lubricant ejection port.

According to the fixing device of the present invention, the pushing member preferably has a cylindrical shape.

According to the fixing device of the present invention, the pushing member preferably has flexibility.

According to the fixing device of the present invention, the holding unit is preferably disposed in an upstream side of the pressing member in a rotational direction of the fixing belt, and the rotation of the fixing belt preferably supplies, between the fixing belt and the pressing member, the lubricant ejected from the lubricant ejection port to the inner periphery of the fixing belt.

According to the fixing device of the present invention, the pressing member preferably includes at least one opening facing the inner periphery of the fixing belt; a channel section communicating with the opening; and an introducing portion for introducing gas into the channel section, and the gas introduced from the introducing portion preferably passes through the channel section and is sent out from the opening.

According to the fixing device of the present invention, the lubricant supply unit preferably has a rotary axis parallel to an extending direction in which the lubricant ejection port extends and includes a stirring member configured to stir the lubricant held inside the holding unit by rotating around the rotary axis.

To achieve the abovementioned object, according to an aspect, an image forming apparatus reflecting one aspect of the present invention comprises: an image forming section configured to form a toner image on a recording medium conveyed along a conveyance channel; and the fixing device described above configured to fix the toner image on the recording medium conveyed along the conveyance channel.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
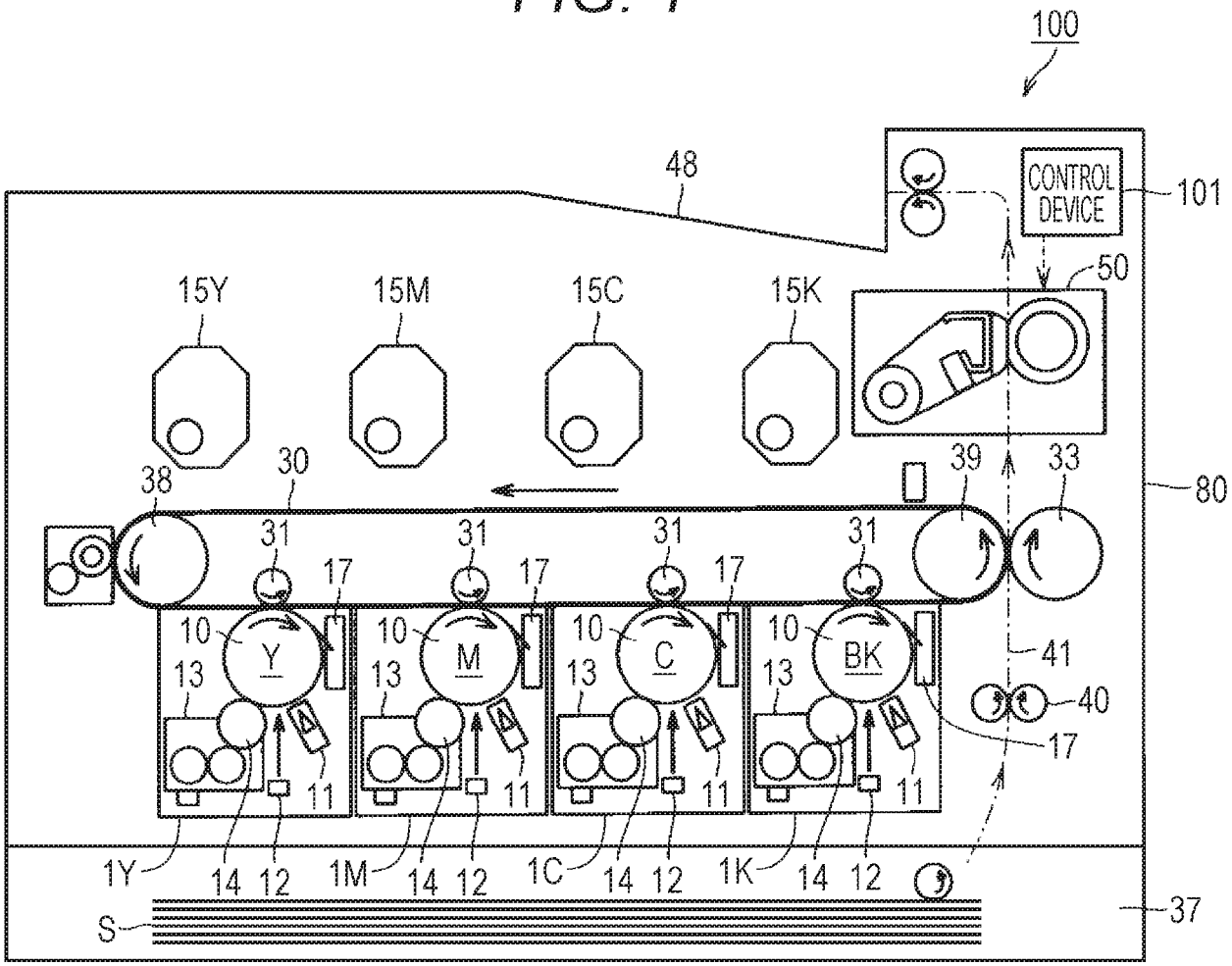
FIG. 1 is a schematic view of an image forming apparatus according to a first embodiment.

Hereinafter, an embodiment of the present invention will be described in detail with reference to the drawings. However, the scope of the invention is not limited to the illustrated examples. In the following embodiment, note that the same or common parts are denoted by the same reference numerals in the drawings, and description thereof will not be repeated.

(First Embodiment)

(Image Forming Apparatus)

With reference to FIG. 1, hereinafter described is an image forming apparatus 100 with a fixing device 50 mounted thereon. FIG. 1 is a view showing an example of an internal structure of the image forming apparatus 100.

FIG. 1 shows the image forming apparatus 100 serving as a color printer. Hereinafter described is the image forming apparatus 100 as a color printer, but the image forming apparatus 100 is not limited to a color printer. For example, the image forming apparatus 100 may be a monochrome printer, a facsimile machine, or a multi-function peripheral (MFP) of a monochrome printer, a color printer, and a facsimile machine.

The image forming apparatus 100 includes image forming units 1Y, 1M, 1C, and 1K, an intermediate transfer belt 30, a primary transfer roller 31, a secondary transfer roller 33, a cassette 37, a driven roller 38, a driving roller 39, a timing roller 40, a fixing device 50, a housing 80, and a control device 101.

The housing 80 defines an outer shell of the image forming apparatus 100. The housing 80 contains the image forming units 1Y, 1M, 1C, and 1K, intermediate transfer belt 30, primary transfer roller 31, secondary transfer roller 33, cassette 37, driven roller 38, driving roller 39, timing roller 40, fixing device 50, and control device 101.

The image forming units 1Y, 1M, 1C, and 1K, intermediate transfer belt 30, primary transfer roller 31, secondary transfer roller 33, cassette 37, driven roller 38, driving roller 39, and timing roller 40 compose an image forming section. The image forming section forms a toner image on a sheet S serving as a recording medium conveyed along a conveyance channel 41 to be described.

The image forming units 1Y, 1M, 1C, and 1K are arranged in order along the intermediate transfer belt 30. Receiving toner from a toner bottle 15Y, the image forming unit 1Y forms a yellow (Y) toner image. Receiving toner from a toner bottle 15M, the image forming unit 1M forms a magenta (M) toner image. Receiving toner from a toner bottle 15C, the image forming unit 1C forms a cyan (C) toner image. Receiving toner from a toner bottle 15K, the image forming unit 1K forms a black (BK) toner image.

The image forming units 1Y, 1M, 1C, and 1K are disposed in order of a rotational direction of the intermediate transfer belt 30 along the intermediate transfer belt 30. Each of the image forming units 1Y, 1M, 1C, and 1K includes a photo conductor 10, a charging device 11, an exposing device 12, a developing device 13, and a cleaning device 17.

The charging device 11 uniformly charges a surface of the photo conductor 10. The exposing device 12 irradiates the photo conductor 10 with laser light in accordance with a control signal from the control device 101 and exposes the surface of the photo conductor 10 in accordance with an input image pattern. Accordingly, an electrostatic latent image corresponding to the input image is formed on the photo conductor 10.

The developing device 13 applies a developing bias to a developing roller 14 while rotating the developing roller 14 and attaches toner to the surface of the developing roller 14. Accordingly, the toner is transferred from the developing roller 14 to the photo conductor 10, and a toner image corresponding to the electrostatic latent image is developed on the surface of the photo conductor 10.

The photo conductor 10 and intermediate transfer belt 30 are in contact with each other at a portion where the primary transfer roller 31 is provided. The primary transfer roller 31 has a roller shape and is rotatable. When a transfer voltage having a polarity opposite to that of the toner image is applied to the primary transfer roller 31, the toner image is transferred from the photo conductor 10 to the intermediate transfer belt 30. A yellow (Y) toner image, a magenta (M) toner image, a cyan (C) toner image, and a black (BK) toner image are sequentially superimposed and transferred from the photo conductor 10 to the intermediate transfer belt 30. Accordingly, a color toner image is formed on the intermediate transfer belt 30.

The intermediate transfer belt 30 is stretched by the driven roller 38 and driving roller 39. The driving roller 39 is rotatively driven by, for example, a motor (not shown). The intermediate transfer belt 30 and driven roller 38 rotate in conjunction with the driving roller 39. Accordingly, the toner image on the intermediate transfer belt 30 is conveyed to the secondary transfer roller 33.

The cleaning device 17 is brought into contact with the photo conductor 10 by pressurizing. The cleaning device 17 collects remaining toner on the surface of the photo conductor 10 after transferring the toner image.

In the cassette 37, a sheet S is set. The sheet S is sent one by one from the cassette 37 to the secondary transfer roller 33 by the timing roller 40 along the conveyance channel 41. The secondary transfer roller 33 has a roller shape and is rotatable. The secondary transfer roller 33 applies a transfer voltage having a polarity opposite to that of the toner image to the sheet S being conveyed. Accordingly, the toner image is attracted from the intermediate transfer belt 30 to the secondary transfer roller 33, and the toner image on the intermediate transfer belt 30 is transferred. The timing of conveying the sheet S to the secondary transfer roller 33 is adjusted by the timing roller 40 in accordance with a position of the toner image on the intermediate transfer belt 30. The toner image on the intermediate transfer belt 30 is transferred by the timing roller 40 to an appropriate position on the sheet S.

The fixing device 50 pressurizes and heats the sheet S passing therethrough. Accordingly, the toner image is fixed on the sheet S. In this manner, the fixing device 50 fixes the toner image on the sheet S conveyed along the conveyance channel 41. The sheet S on which the toner image is fixed is ejected to a tray 48.

The abovementioned image forming apparatus 100 employs a tandem method as a printing process, but the printing process of the image forming apparatus 100 is not limited to the tandem method. Arrangement of each component in the image forming apparatus 100 can be appropriately changed in accordance with an employed printing process. Employable examples of the printing process of the image forming apparatus 100 include a rotary method and a direct transfer method. In a case of employing the rotary method, the image forming apparatus 100 is configured to include one photo conductor 10 and a plurality of coaxially rotatable developing devices 13. At the time of printing, the image forming apparatus 100 sequentially guides each developing device 13 to the photo conductor 10 and develops a toner image of each color. In a case of employing the direct transfer method, the image forming apparatus 100 directly transfers a toner image formed on the photo conductor 10 onto a sheet S.

(Fixing Device)

Figure 2:
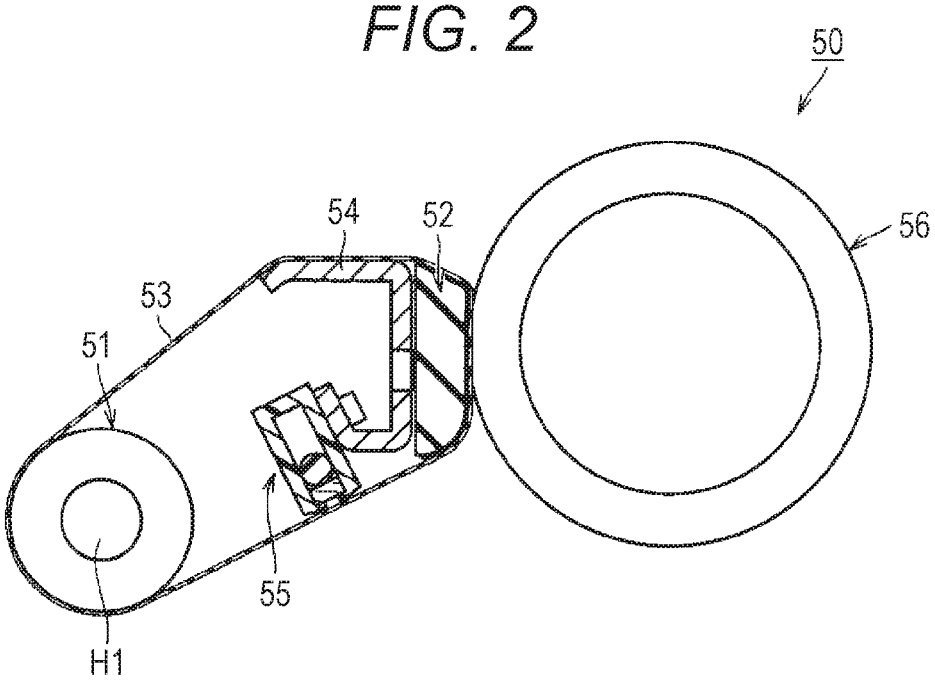
FIG. 2 is a schematic view of a fixing device according to the first embodiment.
Figure 3:
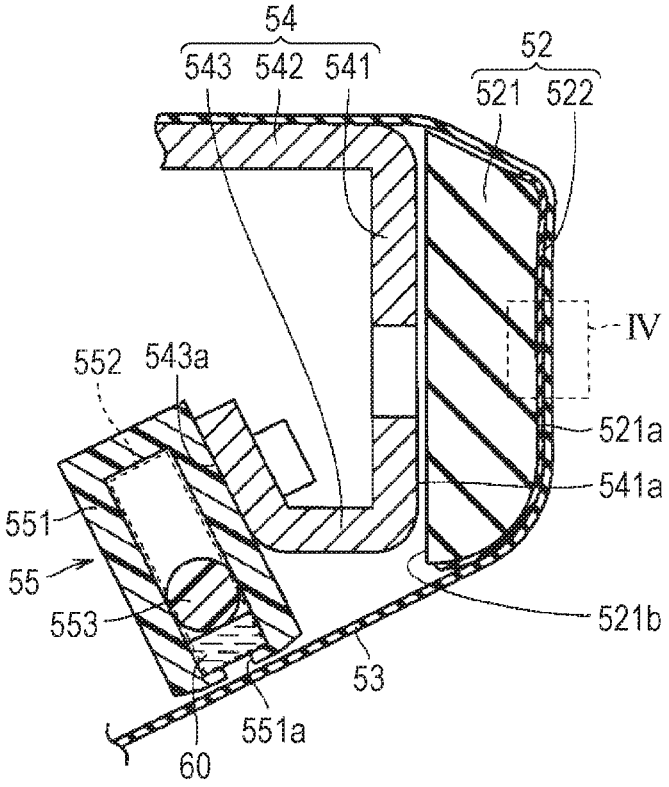
FIG. 3 is a partially enlarged view of the fixing device according to the first embodiment.
Figure 4:
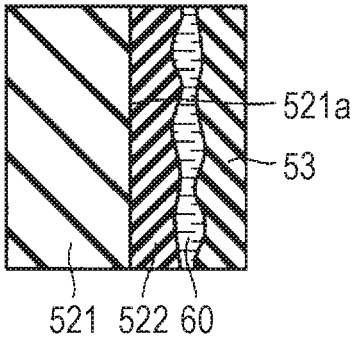
FIG. 4 is an enlarged view of a portion surrounded by the line IV shown in FIG. 3.

FIG. 2 is a schematic view of the fixing device according to the first embodiment. FIG. 3 is a partially enlarged view of the fixing device according to the first embodiment. FIG. 4 is an enlarged view of a portion surrounded by the IV line shown in FIG. 3. The fixing device 50 according to the first embodiment will now be described with reference to FIGS. 2 to 4.

As shown in FIG. 2, the fixing device 50 includes a heating roller 51, a pressing member 52, a fixing belt 53, an anchorage member 54, a lubricant supply unit 55, and a fixing roller 56 as a fixing member.

The heating roller 51 is disposed inside the fixing belt 53. The heating roller 51 includes a heater H1, a cored bar, and a surface layer. The heating roller 51 is heated by the heater H1 and transfers the heat received from the heater H1 to the fixing belt 53.

The cored bar is made of aluminum or iron and has a pipe shape. The cored bar has a thickness of, for example, 0.2 mm to 1 mm. The heater H1 is disposed inside the cored bar. The surface layer of the heating roller 51 is formed on the outer periphery of the cored bar. The surface layer of the heating roller 51 is preferably coated with PTF having heat resistance and abrasion resistance.

The case where the fixing belt 53 is heated by the heater H1 included in the heating roller 51 has been illustrated, but a heating process is not limited thereto. A fixing belt may be configured to contain a heat generating layer of non-magnetic metal by an IH fixing technique, and an IH coil for generating an alternating magnetic field may be sandwiched together with the fixing belt by two magnetic members disposed inside and outside the IH coil so that the fixing belt is heated by induction heating.

As shown in FIGS. 2 to 4, the pressing member 52 is disposed apart from the heating roller 51. The pressing member 52 is disposed inside the fixing belt 53. The pressing member 52 is provided so as to face the fixing roller 56 with the fixing belt 53 interposed therebetween. The pressing member 52 presses the fixing roller 56, involving the fixing belt 53. Accordingly, an elastic layer of the fixing roller 56 to be described is deformed, and a nip portion is formed between the fixing belt 53 and the fixing roller 56.

The pressing member 52 includes a block portion 521 and a sliding sheet 522. The block portion 521 extends in a direction parallel to an axial direction of the heating roller 51. The block portion 521 is longer than a width of the sheet S in the axial direction of the heating roller 51. The block portion 521 includes, for example, resin such as polyphenylene sulfide, polyimide, or liquid crystal polymer.

The sliding sheet 522 is provided on a surface 521*a* of the block portion 521 positioned in the inner periphery of the fixing belt 53. The sliding sheet 522 holds a lubricant 60 supplied between the pressing member 52 and the inner periphery of the fixing belt 53. The sliding sheet 522 includes fluororesin such as polytetrafluoroethylene (PTFE) and perfluoroalkoxy (PFA) fluororesin.

The fixing belt 53 is stretched by the heating roller 51 and the pressing member 52. The fixing belt 53 is an endless belt and is rotatable. The fixing belt 53 rotates so as to transmit heat received from the heating roller 51 to the nip portion, which is a contact portion between the fixing belt 53 and the fixing roller 56. As the sheet S passes through the nip portion, the toner image is fused on the sheet S, and the toner image is fixed on the sheet S.

The fixing belt 53 includes, for example, a base layer and an elastic layer. The base layer of the fixing belt 53 includes a polyimide film. The base layer of the fixing belt 53 has an inner diameter of 50 mm, a width of 330 mm, and a thickness of 70 μm. The elastic layer of the fixing belt 53 includes silicone rubber. The elastic layer of the fixing belt 53 has a thickness of, for example, 100 μm to 200 μm. The surface of the fixing belt 53 may be coated with fluorine. The coating fluorine has a thickness of, for example, 30 μm.

The anchorage member 54 fixes the pressing member 52 and lubricant supply unit 55. The anchorage member 54 includes a base portion 541, a guiding portion 542, and a mounting portion 543. The base portion 541 has a mounting surface 541*a* parallel to a back surface 521*b* of the block portion 521. The block portion 521 is fixed to the mounting surface 541*a* with an adhesive or the like.

The guiding portion 542 is erected at one end of the base portion 541. The guiding portion 542 extends so as to be apart from the block portion 521. The guiding portion 542 contacts the inner periphery of the fixing belt 53 and guides the movement of the fixing belt 53.

The mounting portion 543 is erected at the other end of the base portion 541. The mounting portion 543 is provided so as to be apart from the block portion 521, and a leading end of the mounting portion 543 is bent so as to approach the base portion 541. A bending angle at the leading end of the mounting portion 543 is adjusted so that an opening surface of an ejection port 551*a* to be described becomes parallel to the inner periphery of the fixing belt 53 with the lubricant supply unit 55 being mounted. The mounting portion 543 has a mounting surface 543*a*. One side surface of the lubricant supply unit 55 is fixed to this mounting surface 543*a* with an adhesive or the like.

The lubricant supply unit 55 is disposed inside the fixing belt 53. The lubricant supply unit 55 is for supplying the lubricant 60 between the pressing member 52 and the fixing belt 53 by supplying the lubricant to the inner periphery of the fixing belt 53.

More specifically, the lubricant supply unit 55 is for supplying the lubricant 60 to the inner periphery of the fixing belt 53 when the lubricant 60 which has been supplied in advance between the fixing belt 53 and the pressing member 52 deteriorates or decreases due to a long period of use of the image forming apparatus 100.

The lubricant supply unit 55 includes a holding unit 551 and a pushing member 553. The holding unit 551 holds the lubricant 60. The holding unit 551 is fixed to the mounting surface 543*a* of the mounting portion 543 so as not to be in contact with the inner periphery of the fixing belt 53.

The holding unit 551 has a tubular shape, including the ejection port 551*a* configured to open toward the inner periphery of the fixing belt 53. The ejection port 551*a* has an elongated shape extending along a width direction of the fixing belt 53. The ejection port 551*a* has an opening area equal from one to the other end of the ejection port 551*a* in the width direction of the fixing belt 53.

The holding unit 551 is provided with a storage space 552 for storing the pushing member 553 and the lubricant 60. The holding unit 551 is disposed in an upstream side of the pressing member 52 in a rotational direction of the fixing belt 53. Note that details of the lubricant supply unit 55 will be described later with reference to FIG. 5.

The fixing roller 56 is disposed outside the fixing belt 53. The fixing roller 56 faces the pressing member 52. The fixing roller 56 presses the pressing member 52 with the fixing belt 53 sandwiched therebetween. Accordingly, the fixing belt 53 is brought into contact with the fixing roller 56 by pressurizing.

The fixing roller 56 includes, for example, a cored bar and a surface layer. The cored bar is made of aluminum or iron and has a pipe shape. The surface layer is an elastic layer such as silicone rubber. The elastic layer has a thickness of about several millimeters.

Figure 5:
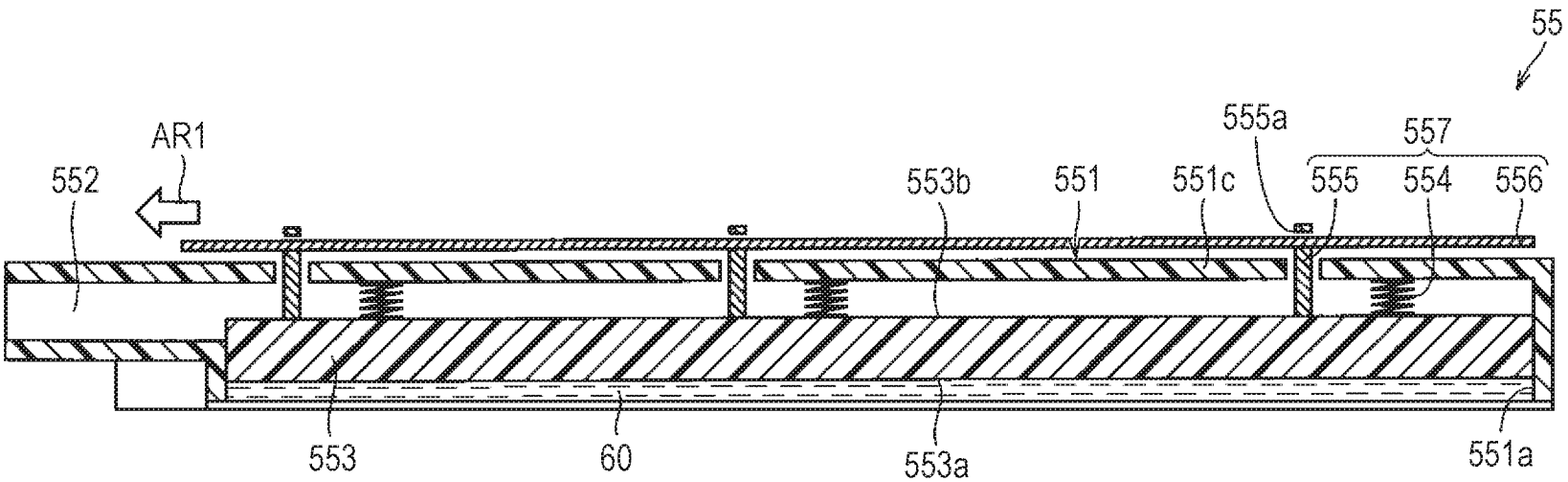
FIG. 5 is a cross sectional view of a lubricant supply unit included in the fixing device according to the first embodiment.

FIG. 5 is a cross sectional view of the lubricant supply unit included in the fixing device according to the first embodiment. The details of the lubricant supply unit will now be described with reference to FIG. 5.

As shown in FIG. 5, the lubricant supply unit 55 includes the holding unit 551, the pushing member 553, and an external force application system 557. The holding unit 551 has a tubular shape having the ejection port 551*a* as described above. The holding unit 551 extends in the width direction of the fixing belt 53.

The storage space 552 is provided inside the holding unit 551. An upper wall 551*c* of the holding unit 551 that defines the storage space 552 is located at a height substantially equivalent from one end to the other end in a longitudinal direction.

The storage space 552 is provided in such a manner that a height along a direction perpendicular to the opening surface of the ejection port 551*a* differs between one end and the other end in the longitudinal direction. The height of the storage space 552 at the other end is larger than that of the storage space 552 at one end.

The lubricant 60, the pushing member 553, a spring 554 to be described, and a part of a supporting unit 555 are stored in the storage space 552 located at the other end. The lubricant 60 is stored in the storage space 552 so as to be adjacent to the ejection port 551*a*.

The pushing member 553 is stored in the holding unit 551 in a side opposite to a side where the ejection port 551*a* is located with respect to the lubricant 60. Specifically, the pushing member 553 is stored inside the storage space 552 so as to be movable toward the ejection port 551*a*. As moving toward the ejection port 551*a*, the pushing member 553 pushes the lubricant 60 out from the ejection port 551*a*.

The pushing member 553 has a cylindrical shape extending along the width direction of the fixing belt 53. The pushing member 553 has a first surface 553*a* and a second surface 553*b* opposing each other in a normal direction of the opening surface of the ejection port 551*a*. The first surface 553*a* is disposed in the side close to the ejection port 551*a* and the second surface 553*b* is disposed in the side far from the ejection port 551*a*.

As the pushing member 553 extending along the width direction of the fixing belt 53 pushes out the lubricant 60, it is possible to push out the lubricant 60 overall so that the lubricant 60 can be uniformly extruded.

Note that the pushing member 553 is not limited to a cylindrical shape. As long as the pushing member 553 is configured to push out the lubricant 60, the pushing member 553 may have a polygonal prism shape. When the pushing member 553 has a cylindrical shape, it is possible to prevent the pushing member 553 from being stuck with the inner periphery of the holding unit 551 and to smoothly move the pushing member 553.

The pushing member 553 moves as it is pressed toward the ejection port 551*a* by the external force application system 557.

The external force application system 557 applies an external force to the pushing member 553 in order to press the pushing member 553 toward the ejection port 551*a*. The external force application system 557 includes a plurality of springs 554 serving as biasing units, a plurality of supporting units 555, and an engagement unit 556.

The plurality of springs 554 are stored in the holding unit 551 in a side opposite to a side where the lubricant 60 is located with respect to the pushing member 553. The plurality of springs 554 are fixed to the inner periphery of the upper wall 551*c* of the holding unit 551. The plurality of springs 554 biases the pushing member 553 toward the ejection port 551*a*. The plurality of springs 554 are disposed at a predetermined pitch along the width direction of the fixing belt 53, whereby an external force can be uniformly applied to the pushing member 553. As an external force is applied to the pushing member 553 by the biasing units such as the springs 554 or the like, the pushing member 553 can be moved toward the ejection port 551*a*.

The plurality of supporting units 555 are configured to be movable with respect to the holding unit 551. The plurality of supporting units 555 are provided so as to penetrate the upper wall 551*c* of the holding unit 551. The plurality of supporting units 555 extend in the direction perpendicular to the opening surface of the ejection port 551*a*. The plurality of supporting units 555 are disposed at a predetermined pitch along the width direction of the fixing belt 53.

A root of each supporting unit 555 located in the storage space 552 is fixed to the pushing member 553. An engaged portion 555*a* to be engaged with the engagement unit 556 is provided to a leading end of each supporting unit 555 projecting outward from the upper wall 551*c*. The engaged portion 555*a* includes, for example, a groove.

The engagement unit 556 has a substantially plate-like shape. The engagement unit 556 disengageably engages with the plurality of supporting units 555. A part of the engagement unit 556 fits into the engaged portion 555*a* of each supporting unit 555, whereby the engagement unit 556 is engaged with each supporting unit 555. The engagement unit 556 is configured to be slidable, for example, in a direction of the arrow AR1 in FIG. 5. As the engagement unit 556 moves in the direction of the arrow AR1, the engagement between the engagement unit 556 and the supporting units 555 is released.

In a state before the lubricant 60 is ejected from the ejection port 551*a*, the engagement unit 556 is engaged with the supporting units 555 so that the supporting units 555 support the pushing member 553 while counteracting biasing forces of the springs 554. In this manner, as the supporting units 555 support the pushing member 553 while being engaged with the engagement unit 556, it is possible to prevent the lubricant 60 from undesirably being in contact with the fixing belt 53. Furthermore, the engagement between the engagement unit 556 and the supporting units 555 at a desirable timing brings about the supply of the lubricant 60 at a desirable timing.

Due to a long period of use of the image forming apparatus 100, when the number of printed sheets reaches a predetermined number or when the lubricant 60 which has been supplied in advance between the fixing belt 53 and the pressing member 52 deteriorates or decreases and the load for driving the fixing belt 53 increases, the engagement unit 556 is slid as described above.

Accordingly, the engagement between the supporting units 555 and the engagement unit 556 is released, and the biasing forces of the springs 554 cause the pushing member 553 to move toward the ejection port 551*a* together with the supporting units 555. Thus, the lubricant 60 is ejected from the ejection port 551*a* to the inner periphery of the fixing belt 53 by the pushing member 553.

The ejection port 551*a* is configured to have the opening area equal from one end to the other end along the longitudinal direction, and the lubricant 60 is ejected from the ejection port 551*a* substantially uniformly along the width direction of the fixing belt 53.

The lubricant 60 ejected from the ejection port 551*a* toward the inner periphery of the fixing belt 53 is scraped off by the fixing belt 53 as the fixing belt 53 rotates. Therefore, even when employing a lubricant 60 having low surface tension, a small amount of the lubricant 60 held in the holding unit 551 can be efficiently ejected onto the inner periphery of the fixing belt 53.

As the fixing belt 53 rotates, the lubricant 60 ejected onto the inner periphery of the fixing belt 53 is substantially uniformly supplied between the fixing belt 53 and the pressing member 52 along the width direction of the fixing belt 53.

As described above, in the fixing device 50 according to the first embodiment, the lubricant supply unit 55 includes the holding unit 551 disposed inside the fixing belt 53, holding the lubricant 60, and provided with the ejection port 551*a* having a longitudinal shape extending along the width of the fixing belt 53. Therefore, it is possible to uniformly eject the lubricant 60 held in the holding unit 551 from the ejection port 551*a* along the width direction of the fixing belt 53 and to uniformly supply the lubricant 60 between the fixing belt 53 and the pressing member 52 along the width direction.

Accordingly, in the fixing device 50 according to the first embodiment and the image forming apparatus 100 including the same, it is possible to moderate the lubricant 60 to be supplied between the pressing member 52 and the fixing belt 53, while holding a small amount of the lubricant 60. Thus, a lifetime of the fixing device 50 can be prolonged.

In addition, the holding unit 551 is provided to the fixing belt 53 without being in contact so that it is possible to prevent the fixing belt 53 from being in contact with the holding unit 551 and to prevent a heat capacity of the fixing device 50 from growing large. Accordingly, it is possible to save energy and shorten a warm-up time.

Furthermore, as the lubricant supply unit 55 is disposed inside the fixing belt 53 and the lubricant 60 can be ejected to the inner periphery of the fixing belt 53 at a desired timing, it is possible to additionally supply the lubricant 60 between the fixing belt 53 and the pressing member 52 without disassembling the fixing device 50. Thus, maintenance can be simplified.

(First Modification)

(Lubricant Supply Unit)

Figure 6:
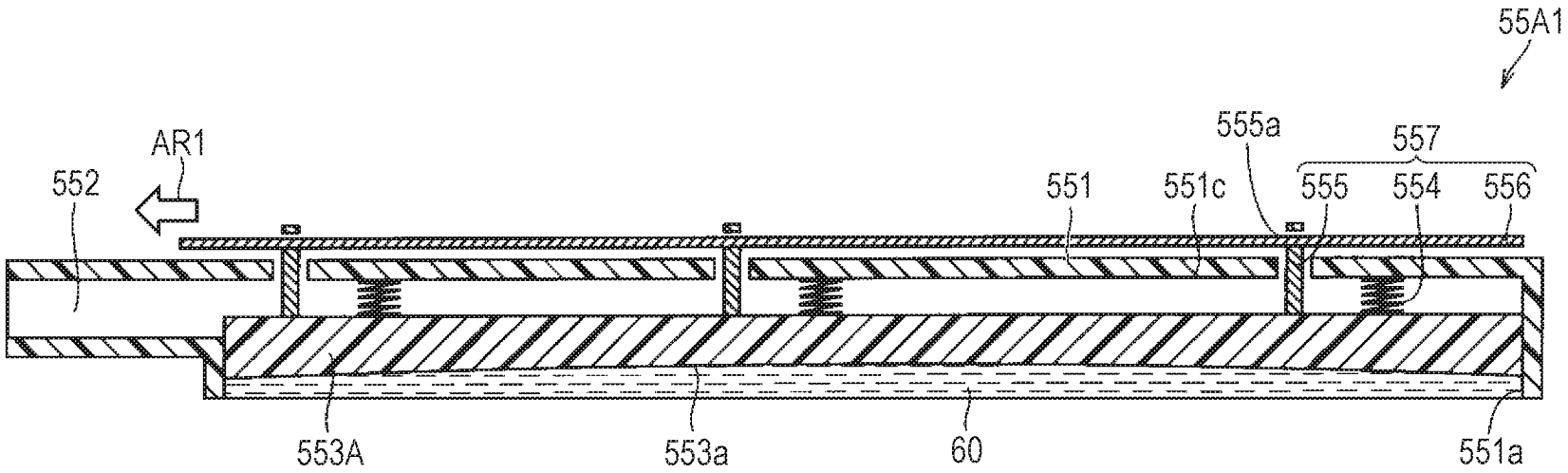
FIG. 6 is a cross sectional view of a lubricant supply unit according to a first modification.

FIG. 6 is a cross sectional view of a lubricant supply unit according to a first modification. With reference to FIG. 6, a lubricant supply unit 55A1 according to the first modification will be described.

As shown in FIG. 6, compared to the lubricant supply unit 55 according to the first embodiment, the lubricant supply unit 55A1 according to the first modification is different in that, in a width direction of a fixing belt 53, an amount of a lubricant 60 to be ejected from a central part of an ejection port 551*a* is larger than that to be ejected from both ends of the ejection port 551*a*.

Specifically, the lubricant supply unit 55A1 according to the first modification is different from the lubricant supply unit 55 according to the first embodiment in a configuration of a pushing member 553A. Other configurations are substantially similar.

The pushing member 553A is configured in such a manner that a first surface 553*a* located in a side close to the ejection port 551*a* gets farther from the ejection port 551*a* as moving from both ends in a longitudinal direction along the width direction of the fixing belt 53 toward the central part.

Accordingly, in a state before the lubricant 60 is ejected from the ejection port 551*a*, the lubricant 60 is held by the holding unit 551 in such a manner that a height of the lubricant 60 from an opening surface in a normal direction of the opening surface of the ejection port 551*a* is larger in the central part than in both ends of the lubricant 60 in the width direction of the fixing belt 53.

As described above, as the lubricant 60 is held in the holding unit 551, the amount of the lubricant 60 to be ejected from the central part of the ejection port 551*a* can be made larger than that to be ejected from both ends of the ejection port 551*a*.

In a nip portion formed between the fixing belt 53 and a fixing roller 56, due to a setting of pressure distribution, an amount of decrease in the lubricant 60 which has been supplied in advance between the fixing belt 53 and a pressing member 52 may differ in the width direction of the fixing belt 53 in accordance with a long period of use.

Therefore, by changing an amount of the lubricant 60 to be held for additional supply in accordance with the amount of decrease in the lubricant 60, depending on the width direction of the fixing belt 53, even a fixing device and an image forming apparatus including the lubricant supply unit 55A1 according to the first modification can moderate the lubricant 60 to be supplied between the pressing member 52 and the fixing belt 53, while holding a small amount of the lubricant 60. Accordingly, it is possible to prevent excessive supply of the lubricant 60 and to avoid such a problem that the lubricant 60 leaks from an end portion of the fixing belt 53, which causes image abnormality.

In addition, since the lubricant 60 is not moved from the outside of the fixing belt 53 as in the prior document (JP 2014-174434 A), at the time of supplying the lubricant 60 and at the time of maintenance, not only a fixing device 50 but also the inside of an image forming apparatus 100 can be prevented from being contaminated.

Specifically, pressure tends to be high in the central part rather than in both ends in the width direction of the fixing belt 53. In such a case, as the amount of the lubricant 60 to be held is distributed as described above, the abovementioned effects can be efficiently exerted.

(Second Modification)

(Lubricant Supply Unit)

Figure 7:
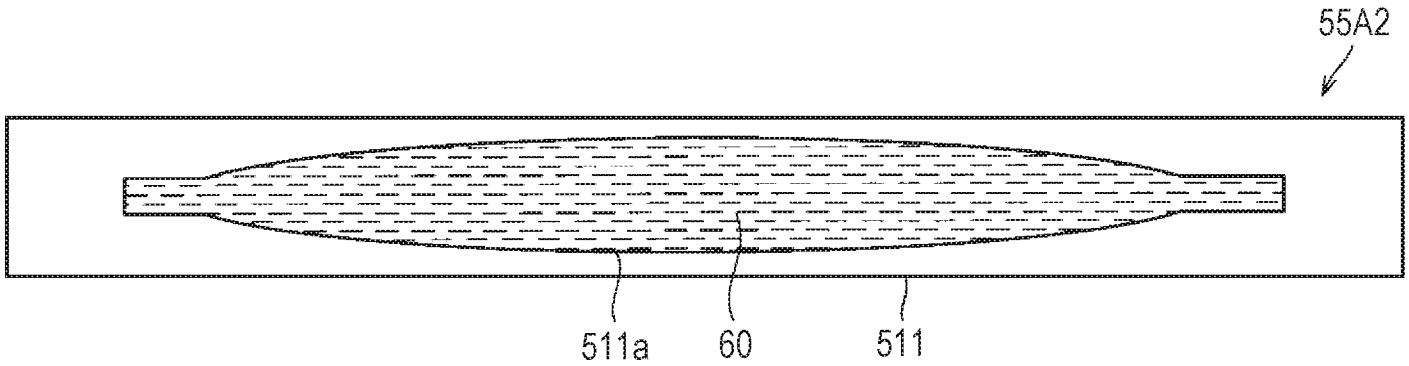
FIG. 7 is a view showing an ejection port of a lubricant supply unit according to a second modification.

FIG. 7 is a view showing an ejection port of a lubricant supply unit according to a second modification. With reference to FIG. 7, a lubricant supply unit 55A2 according to the second modification will be described.

As shown in FIG. 7, compared to the lubricant supply unit 55 according to the first embodiment, the lubricant supply unit 55A2 according to the second modification is different in that, in a width direction of a fixing belt 53, an amount of a lubricant 60 to be ejected from a central part of an ejection port 551*a* is larger than that to be ejected from both ends of the ejection port 551*a*.

Specifically, the lubricant supply unit 55A2 according to the second modification is different from the lubricant supply unit 55 according to the first embodiment in shape of the ejection port 551*a*. Other configurations are substantially similar.

In the width direction of the fixing belt 53, an opening area of the ejection port 551*a* in the central part of the ejection port 551*a* is larger than opening areas in both ends of the ejection port 551*a*. More specifically, in the width direction of the fixing belt 53, the opening area of the ejection port 551*a* increases as moving from both ends toward the central part.

Accordingly, by making the shape of the ejection port 551*a* as described above, the amount of the lubricant 60 to be ejected from the central part of the ejection port 551*a* can be made larger than that to be ejected from both ends of the ejection port 551*a*.

As described above, even in a fixing device and an image forming apparatus including the lubricant supply unit 55A2 according to the second modification, it is possible to obtain effects substantially similar to those obtained in the fixing device and the image forming apparatus including the lubricant supply unit 55A1 according to the first modification.

(Second Embodiment)

(Image Forming Apparatus)

Figure 8:
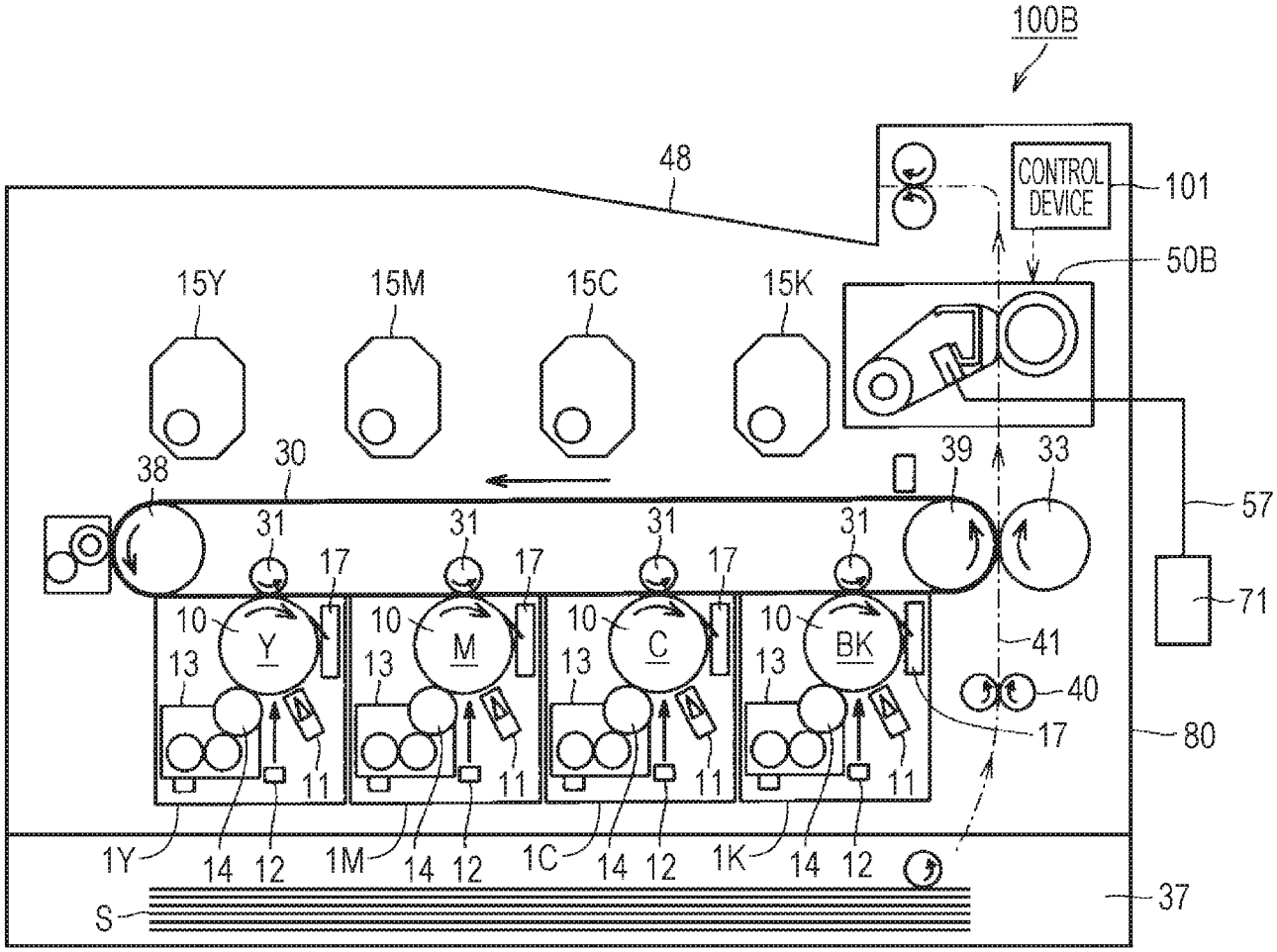
FIG. 8 is a schematic view of an image forming apparatus according to a second embodiment.

FIG. 8 is a schematic view of an image forming apparatus according to a second embodiment. With reference to FIG. 8, an image forming apparatus 100B according to the second embodiment will be described.

As shown in FIG. 8, compared to the image forming apparatus 100 according to the first embodiment, the image forming apparatus 100B according to the second embodiment is different in that the image forming apparatus 100B includes a gas supply source 71 and in a configuration of a fixing device 50B. Other configurations are substantially similar.

The gas supply source 71 is disposed outside a housing 80. The gas supply source 71 is for supplying gas to a holding unit 551B (see FIG. 9) of a lubricant supply unit 55B (see FIG. 9) to be described. The gas supplied from the gas supply source 71 is preferably air, but is not particularly limited to air. The gas supply source 71 includes, for example, a cylinder or a compressor. In a case where the gas supply source 71 includes a cylinder, it is preferable that the gas supply source 71 is configured to be replaceable.

The fixing device 50B is different from the fixing device 50 according to the first embodiment in a configuration of the lubricant supply unit 55B.

(Lubricant Supply Unit)

Figure 9:
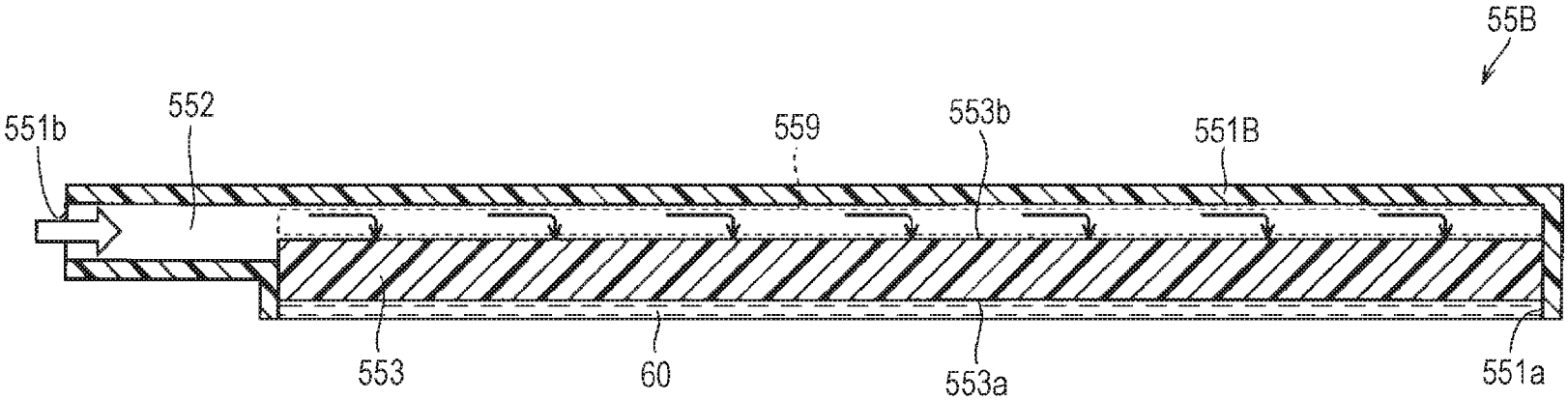
FIG. 9 is a cross sectional view of a lubricant supply unit included in a fixing device according to the second embodiment.

FIG. 9 is a cross sectional view of the lubricant supply unit included in the fixing device according to the second embodiment. With reference to FIG. 9, the lubricant supply unit 55B according to the second embodiment will be described.

Compared to the lubricant supply unit 55 according to the first embodiment, the lubricant supply unit 55B according to the second embodiment is different in that a pushing member 553 pushes an ejection port 551*a* by pressure of the gas supplied into the holding unit 551B.

As shown in FIG. 9, the lubricant supply unit 55B includes the holding unit 551B, the pushing member 553, and a pipe 57 (see FIG. 8).

The pipe 57 is for introducing gas from the gas supply source 71 to an introduction port 551*b* of the holding unit 551B to be described. One end of the pipe 57 is connected to the introduction port 551*b* of the holding unit 551B. The other end of the pipe 57 is drawn to the outside of the fixing device 50B and further to the outside of the housing 80 of the image forming apparatus 100B so as to be connected to the gas supply source 71. The other end of the pipe 57 is detachably connected to the gas supply source 71. Provision of the pipe 57 leads to wide variations of arrangement of the gas supply source 71. Even when the gas supply source 71 is provided outside the housing 80 as described above, gas can be introduced into the introduction port 551*b* of the holding unit 551B through the pipe 57.

The holding unit 551B has a tubular shape, including the ejection port 551*a* configured to open toward the inner periphery of a fixing belt 53. The holding unit 551B is provided with a storage space 552 for storing the pushing member 553 and a lubricant 60.

In addition to the ejection port 551*a*, the holding unit 551B includes the introduction port 551*b* and an accumulation chamber 559. The introduction port 551*b* is provided to one end of the holding unit 551B in a width direction of the fixing belt 53.

The accumulation chamber 559 communicates with the introduction port 551*b*. The accumulation chamber 559 accumulates the gas introduced into the introduction port 551*b*. The accumulation chamber 559 is a part of the storage space 552. The accumulation chamber 559 is located at a side opposite to a side where the lubricant 60 is located with respect to the pushing member 553.

A bottom of the accumulation chamber 559 includes a second surface 553*b* of the pushing member 553 positioned in a side far from the ejection port 551*a*. Accordingly, when gas is introduced into the accumulation chamber 559, substantially uniform pressure is applied to the second surface 553*b* of the pushing member 553 so that the pushing member 553 moves toward the ejection port 551*a*.

The ejection port 551*a* is configured to have an opening area equal from one end to the other end along the longitudinal direction, and the lubricant 60 is ejected from the ejection port 551*a* substantially uniformly along the width direction of the fixing belt 53.

As the fixing belt 53 rotates, the lubricant 60 ejected from the ejection port 551*a* onto the inner periphery of the fixing belt 53 is substantially uniformly supplied between the fixing belt 53 and the pressing member 52 along the width direction of the fixing belt 53.

As described above, even in the fixing device 50B and the image forming apparatus 100B according to the second embodiment, it is possible to obtain effects substantially similar to those obtained in the fixing device 50 and the image forming apparatus 100 according to the first embodiment.

Furthermore, as the pushing member 553 is configured to be movable toward the ejection port 551*a* by the pressure of the gas supplied into the holding unit 551, it is possible to omit the external force application system 557 as in the first embodiment. Therefore, the configuration of the lubricant supply unit 55B can be simplified.

Note that the gas supply source 71 may be mounted on the image forming apparatus 100B in advance or may be separately mounted by an operator at the time of maintenance and the like. As the gas supply source 71 is configured to be separately mountable, it is possible to downsize the image forming apparatus 100B. As a serviceman, not a user, mounts the gas supply source 71 in after-sales maintenance, it is possible to improve the safety and prevent mistakes in operations.

In the second embodiment, such a case has been illustrated that the gas supply source 71 is provided outside the housing 80 of the image forming apparatus 100B, but the present invention is not limited thereto. The gas supply source 71 may be provided inside the housing 80 of the image forming apparatus 100B.

(Third Embodiment)

Figure 10:
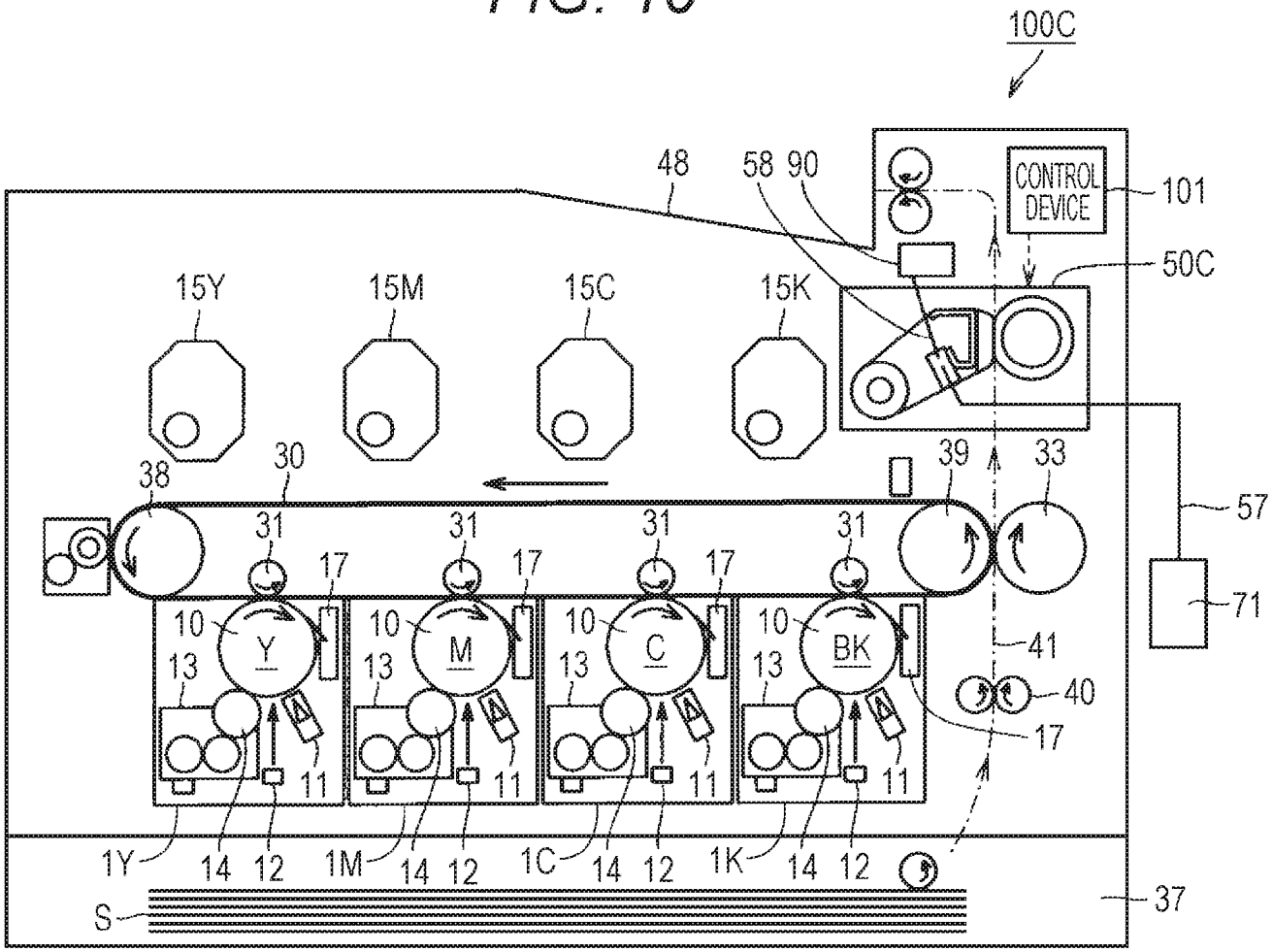
FIG. 10 is a schematic view of an image forming apparatus according to a third embodiment.

FIG. 10 is a schematic view of an image forming apparatus according to a third embodiment. With reference to FIG. 10, an image forming apparatus 100C according to the third embodiment will be described.

Figure 11:
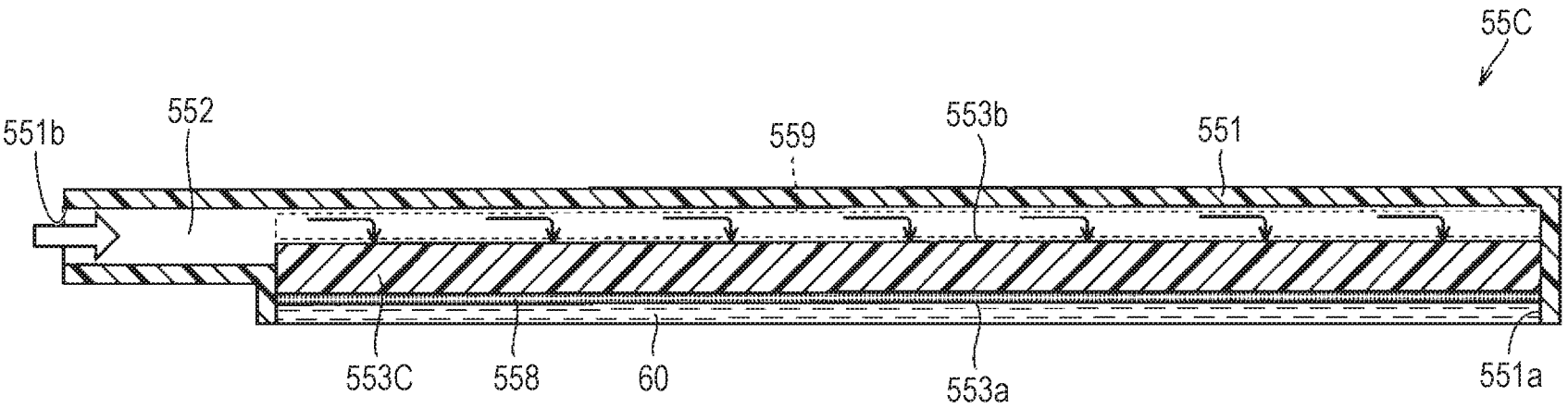
FIG. 11 is a cross sectional view of a lubricant supply unit included in a fixing device according to the third embodiment.

As shown in FIG. 10, compared to the image forming apparatus 100B according to the second embodiment, the image forming apparatus 100C according to the third embodiment is different in that a fixing device 50C includes a decompressing device 90 and in a configuration of a lubricant supply unit 55C (see FIG. 11). Other configurations are substantially similar.

The decompressing device 90 is provided inside a housing 80 of the image forming apparatus 100C. The decompressing device 90 is connected to an accumulation chamber 559 (see FIG. 11) through a pipe 58. The decompressing device 90 decompresses the accumulation chamber 559.

Note that the decompressing device 90 may be provided outside the image forming apparatus 100C. In a case where the decompressing device 90 is provided outside the image forming apparatus 100C, the image forming apparatus 100 can be downsized. In addition, it is possible to reduce the number of assembling steps for mounting devices inside the image forming apparatus 100C, which leads to cost reduction.

FIG. 11 is a cross sectional view of the lubricant supply unit included in the fixing device according to the third embodiment. With reference to FIG. 11, the lubricant supply unit 55C included in the fixing device 50C according to the third embodiment will be described.

As shown in FIG. 11, compared to the lubricant supply unit 55B according to the second embodiment, the lubricant supply unit 55C according to the third embodiment is different in such respects that a pushing member 553C has a different shape and an impregnated member 558 is provided.

The pushing member 553C has a cuboid shape. The impregnated member 558 is provided to a first surface 553*a* of the pushing member 553C. The impregnated member 558 is in contact with a lubricant 60. The impregnated member 558 is impregnated with the lubricant 60. The impregnated member 558 includes a non-woven fabric and the like. The impregnated member 558 is configured to be in contact with the inner periphery of a fixing belt 53 in a state after the pushing member 553C pushes out the lubricant 60.

Figure 12:
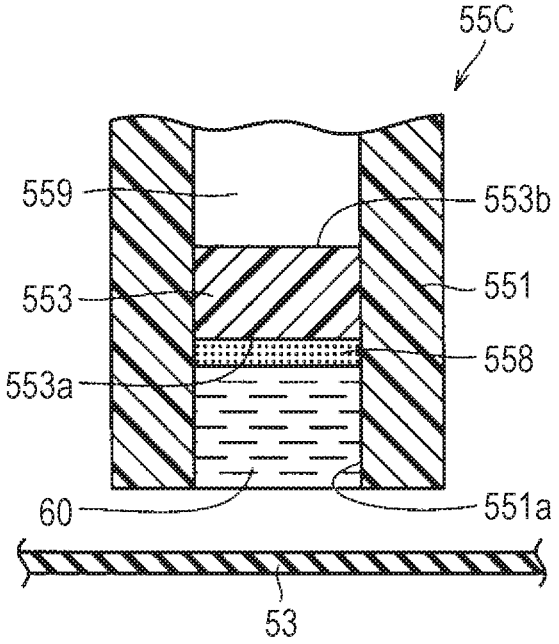
FIG. 12 is a view showing a first state of the lubricant supply unit shown in FIG. 11.
Figure 13:
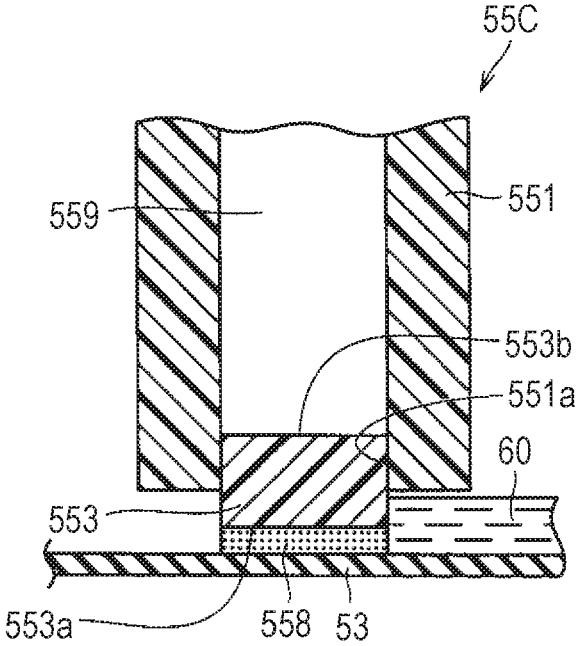
FIG. 13 is a view showing a second state of the lubricant supply unit shown in FIG. 11.
Figure 14:
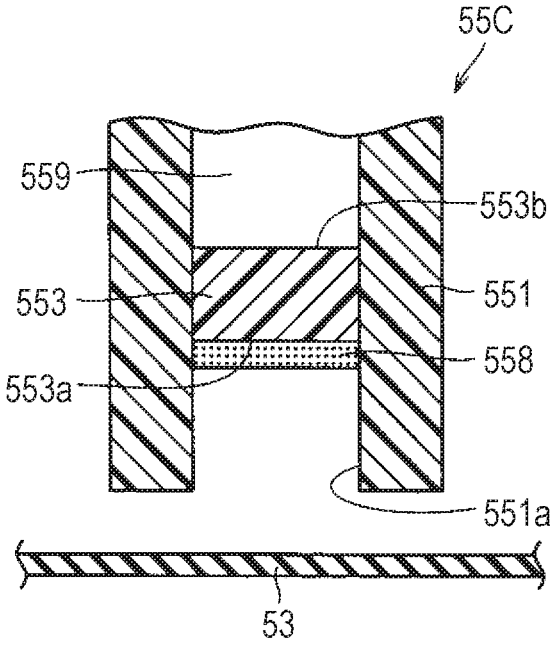
FIG. 14 is a view showing a third state of the lubricant supply unit shown in FIG. 11.

FIG. 12 is a view showing a first state of the lubricant supply unit shown in FIG. 11. FIG. 13 is a view showing a second state of the lubricant supply unit shown in FIG. 11. FIG. 14 is a view showing a third state of the lubricant supply unit shown in FIG. 11. Operations of the lubricant supply unit 55C will be described with reference to FIGS. 12 to 14.

As shown in FIG. 12, the first state of the lubricant supply unit 55C represents a state before the lubricant supply unit 55C supplies the lubricant 60. In the first state of the lubricant supply unit 55C, the accumulation chamber 559 is being decompressed, and a holding unit 551 stores the pushing member 553C and holds the lubricant 60. In this state, no gas is introduced inside the accumulation chamber 559.

From this state, as gas is introduced into the accumulation chamber 559, pressure of the gas moves the pushing member 553C toward an ejection port 551*a*. Accordingly, the lubricant 60 is pushed out from the ejection port 551*a*.

As shown in FIG. 13, in the second state of the lubricant supply unit 55C representing a state after the pushing member 553C moving toward the ejection port 551*a* and the pushing member 553C pushing all the lubricant 60 out, the impregnated member 558 comes into contact with the inner periphery of the fixing belt 53.

As the impregnated member 558 is configured to be in contact with the inner periphery of the fixing belt 53, the lubricant 60 can be sufficiently supplied to the fixing belt 53. Furthermore, as the fixing belt 53 is configured to rotate while the impregnated member 558 is in contact with the fixing belt 53, it is possible to collect foreign materials adhered to the inner periphery of the fixing belt 53.

After the impregnated member 558 is brought into contact with the inner periphery of the fixing belt 53 for a predetermined time, the decompressing device 90 decompresses the accumulation chamber 559. Accordingly, the inside of the accumulation chamber 559 is under negative pressure, and the pushing member 553C protruding outward from the ejection port 551*a* is collected inside the holding unit 551.

As shown in FIG. 14, in the third state of the lubricant supply unit 55C, the pushing member 553C is collected inside the holding unit 551 and held in the holding unit 551 so as not to protrude to the outside of the holding unit 551.

As described above, even in the fixing device 50C and the image forming apparatus 100C according to the third embodiment, it is possible to obtain effects substantially similar to those obtained in the fixing device 50B and the image forming apparatus 100B according to the second embodiment.

In addition, by providing the impregnated member 558 and allowing it to come into contact with the inner periphery of the fixing belt 53, it is possible to sufficiently push the lubricant 60 out to the fixing belt 53 as described above, and to collect the foreign materials adhered to the inner periphery of the fixing belt 53.

Furthermore, by providing the decompressing device 90 and allowing it to decompress the inside of the accumulation chamber 559, it is possible to collect the pushing member 553 into the holding unit 551 after pushing out the lubricant 60. Accordingly, it is possible to prevent the foreign materials adhered to the impregnated member 558 from returning to the inner periphery of the fixing belt 53. Therefore, it is possible to prevent unevenness in contact resistance between the fixing belt 53 and a fixing roller due to the foreign materials.

Still further, by not bringing the impregnated member 558 into contact with the fixing belt 53, it is possible to prevent an increase in heat capacity of the fixing belt 53 and to restrain abrasion of the inner periphery of the fixing belt 53.

Still further, even in a case where the inner periphery of the holding unit 551 is warped due to flexibility of the pushing member 553C, the pushing member 553C can move while deforming in accordance with the warpage of the inner periphery of the holding unit 551. This makes it possible to prevent ejection defects.

(Fourth Embodiment)

(Image Forming Apparatus)

Figure 15:
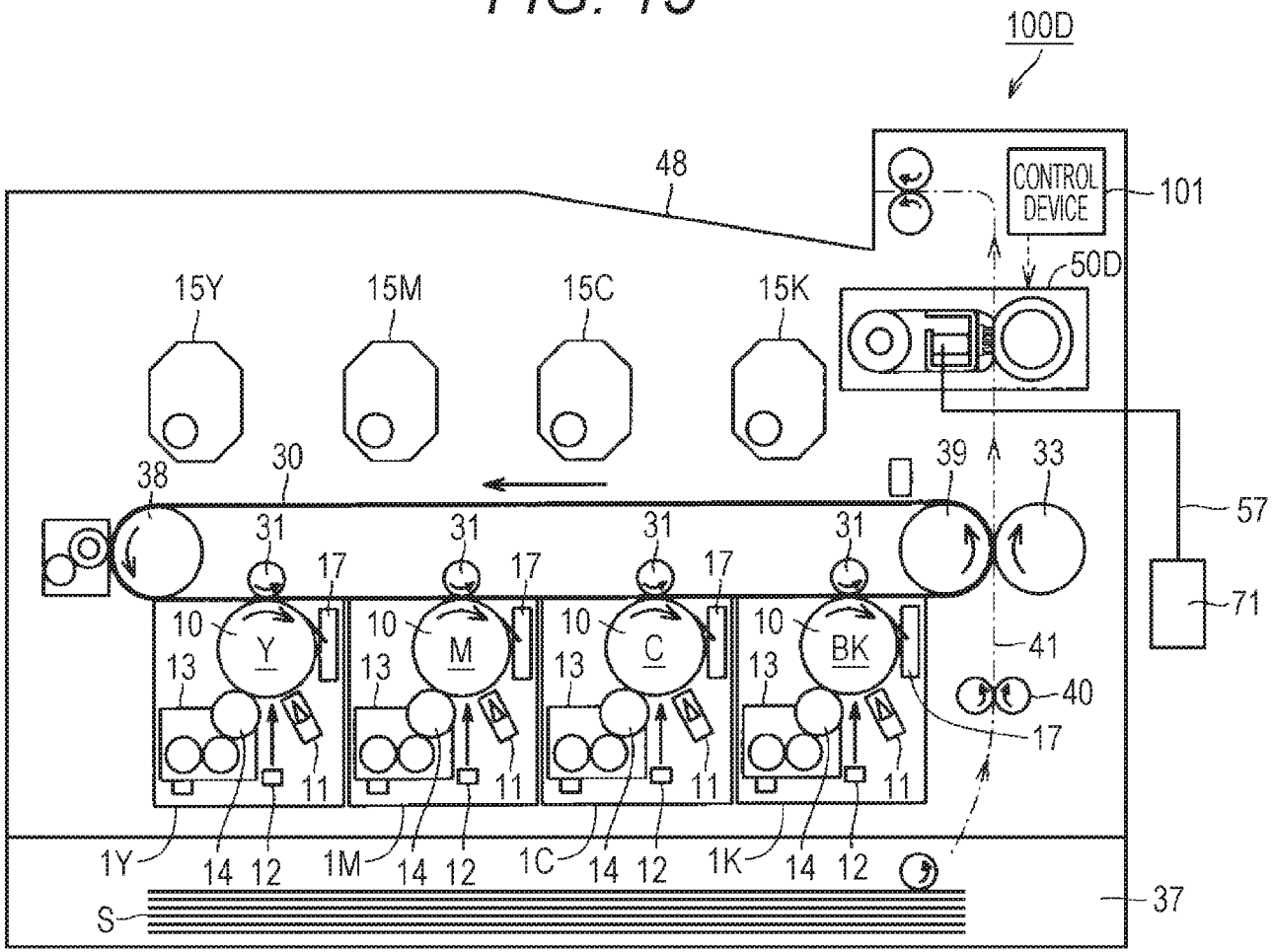
FIG. 15 is a schematic view of an image forming apparatus according to a fourth embodiment.

FIG. 15 is a schematic view of an image forming apparatus according to a fourth embodiment. With reference to FIG. 15, an image forming apparatus 100D according to the fourth embodiment will be described.

As shown in FIG. 15, the image forming apparatus 100D according to the fourth embodiment is different from the image forming apparatus 100B according to the second embodiment in a configuration of a fixing device 50D. Other configurations are substantially similar.

(Fixing Device)

Figure 16:
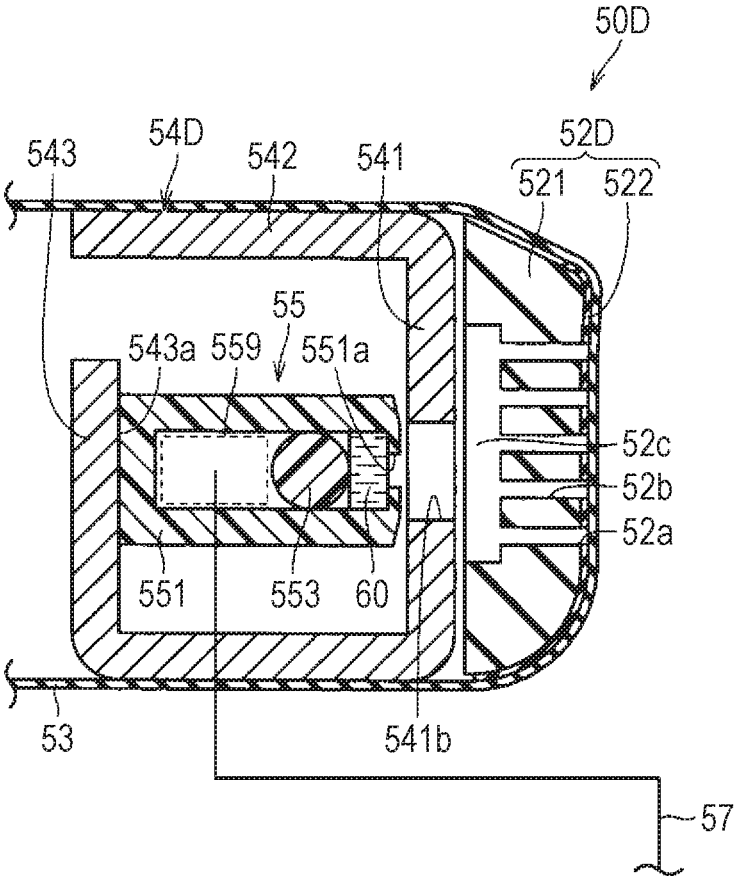
FIG. 16 is a partially enlarged view of a fixing device according to the fourth embodiment.

FIG. 16 is a partial enlarged view of the fixing device according to the fourth embodiment. The fixing device 50D according to the fourth embodiment will be described with reference to FIG. 16.

As shown in FIG. 16, the fixing device 50D according to the fourth embodiment is different from the fixing device 50B according to the second embodiment in a configuration of a pressing member 52D, that of an anchorage member 54D, and arrangement of a lubricant supply unit 55D. Other configurations are substantially similar.

The pressing member 52D includes a plurality of openings 52*a* facing the inner periphery of a fixing belt 53; a channel sections 52*b* communicating with the openings 52*a*; and a lubricant introducing portion 52*c* for supplying a lubricant 60 to the channel sections 52*b*.

The plurality of openings 52*a* is provided so as to penetrate a sliding sheet 522. The lubricant 60 is supplied from the plurality of openings 52*a* to the inner periphery of the fixing belt 53. Each of the plurality of openings 52*a* extends along a width direction of the fixing belt 53. The plurality of openings 52*a* is disposed side by side along a rotational direction of the fixing belt 53. The number of the openings 52*a* is not limited to a plural number, and may be a single number.

The channel sections 52*b* are provided to a block portion 521. The channel sections 52*b* are provided so as to extend in a thickness direction of the block portion 521. One end of each channel section 52*b* is connected to the opening 52*a*, and the other end of each channel section 52*b* is connected to the lubricant introducing portion 52*c*. The lubricant introducing portion 52*c* is provided to a side opposite to a side where the fixing belt 53 is located. The lubricant introducing portion 52*c* is opened toward a base portion 541 of the anchorage member 54D.

A through hole 541*b* is provided to the base portion 541 of the anchorage member 54D. The through hole 541*b* is provided so as to face the lubricant introducing portion 52*c*.

The anchorage member 54D is disposed in a side opposite to a side where the pressing member 52D is positioned with respect to the base portion 541. The anchorage member 54D is fixed to a mounting portion 543 so that an ejection port 551*a* faces the through hole 541*b*.

As gas is introduced into an accumulation chamber 559 of the holding unit 551, the pushing member 553 moves toward the ejection port 551*a*, whereby the lubricant 60 is ejected from the ejection port 551*a*. The lubricant 60 ejected from the ejection port 551*a* passes through the through hole 541*b* of the base portion 541 and is introduced into the lubricant introducing portion 52*c* of the pressing member 52D.

The lubricant 60 introduced into the lubricant introducing portion 52*c* passes through the channel sections 52*b* and is supplied from the plurality of openings 52*a* to the inner periphery of the fixing belt 53 located between the pressing member 52D and a fixing roller. Herein, each of the plurality of openings 52*a* is configured to have an opening area equal from one end to the other end in the longitudinal direction, and the lubricant 60 is ejected from the plurality of openings 52*a* substantially uniformly along the width direction of the fixing belt 53.

As described above, even in the fixing device 50D and the image forming apparatus 100D according to the fourth embodiment, it is possible to obtain effects substantially similar to those obtained in the fixing device 50B and the image forming apparatus 100B according to the second embodiment.

(Fifth Embodiment)

(Image Forming Apparatus)

Figure 17:
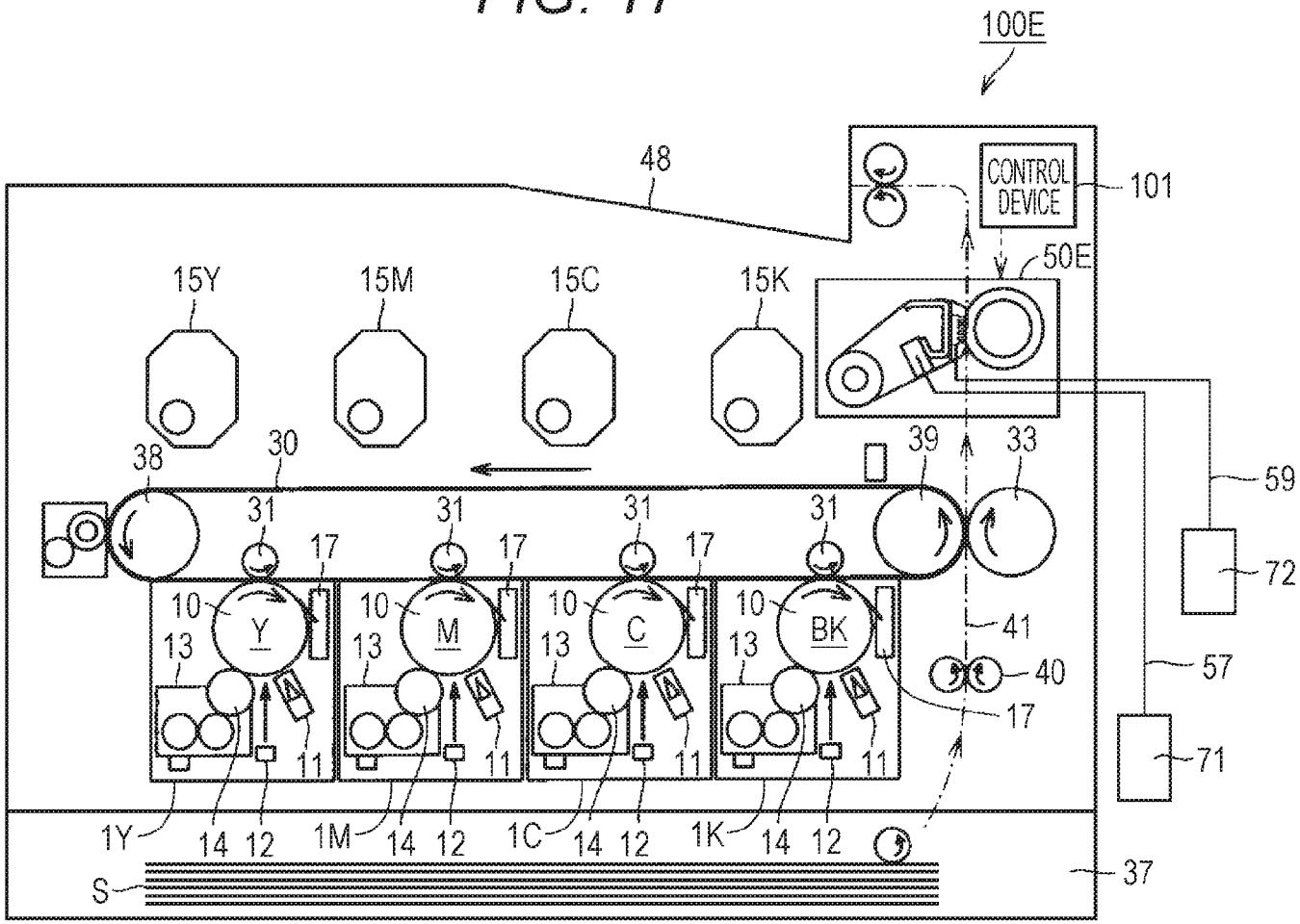
FIG. 17 is a schematic view of an image forming apparatus according to a fifth embodiment.

FIG. 17 is a schematic view of an image forming apparatus according to a fifth embodiment. With reference to FIG. 15, an image forming apparatus 100E according to the fifth embodiment will be described.

As shown in FIG. 17, compared to the image forming apparatus 100B according to the second embodiment, the image forming apparatus 100E according to the fifth embodiment is different in that a second gas supply source 72 is provided and in a configuration of a fixing device 50E. Other configurations are substantially similar.

The gas supply source 72 is disposed outside a housing 80. The gas supply source 72 is for introducing gas to a gas introducing portion 52*c*1 (see FIG. 18) of a pressing member 52E (see FIG. 18) to be described.

The gas supplied from the gas supply source 72 is preferably air, but is not particularly limited to air. The gas supply source 72 includes, for example, a cylinder or a compressor. In a case where the gas supply source 72 includes a cylinder, it is preferable that the gas supply source 72 is configured to be replaceable.

(Fixing Device)

Figure 18:
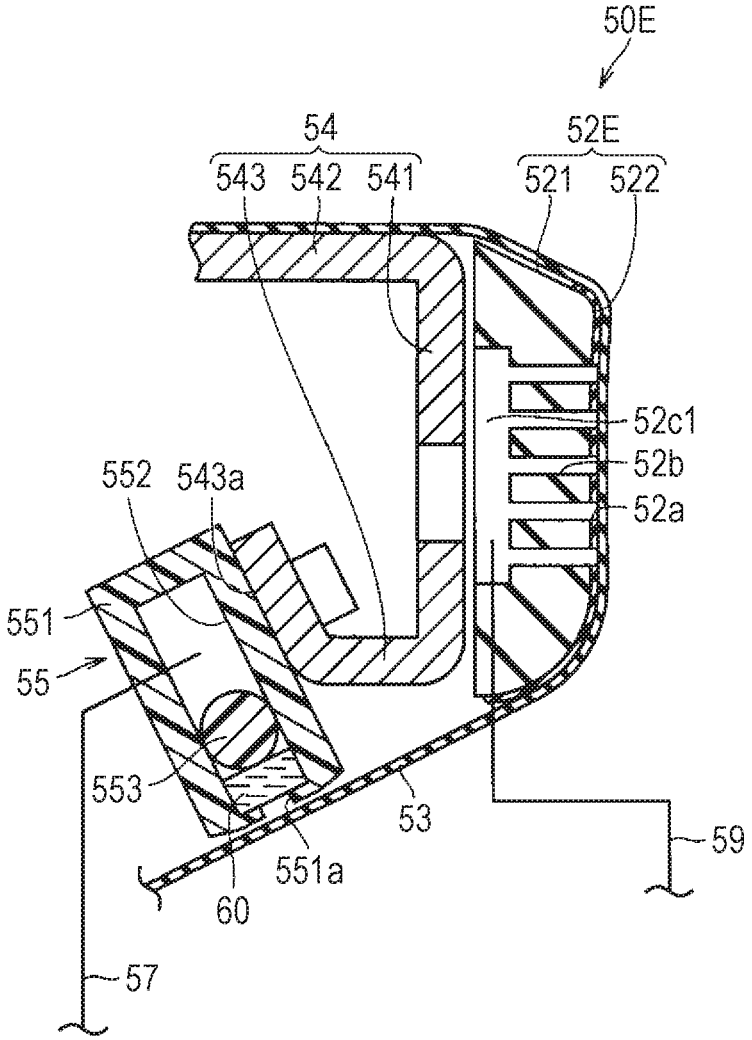
FIG. 18 is a partially enlarged view of a fixing device according to the fifth embodiment.

FIG. 18 is a partially enlarged view of the fixing device according to the fifth embodiment. With reference to FIG. 18, the fixing device 50E according to the fifth embodiment will be described.

As shown in FIG. 18, compared to the fixing device 50B according to the second embodiment, the fixing device 50E according to the fifth embodiment is different in that a pipe 59 (see FIG. 17) is provided and in a configuration of the pressing member 52E. Other configurations are substantially similar.

The pipe 59 is for introducing gas from the gas supply source 72 to the gas introducing portion 52*c*1 of the pressing member 52E. One end of the pipe 59 is connected to the gas introducing portion 52*c*1. The other end of the pipe 59 is drawn to the outside of the fixing device 50E and further to the outside of the housing 80 of the image forming apparatus 100E so as to be connected to the gas supply source 72.

The other end of the pipe 59 is detachably connected to the gas supply source 72. Provision of the pipe 59 leads to wide variations of arrangement of the gas supply source 72. Even when the gas supply source 72 is provided outside the housing 80 as described above, gas can be introduced into the gas introducing portion 52*c*1 through the pipe 59.

The pressing member 52E includes a plurality of openings 52*a* facing the inner periphery of a fixing belt 53; channel sections 52*b* communicating with the openings 52*a*; and a gas introducing portion 52*c*1 for supplying gas to the channel sections 52*b*.

The plurality of openings 52*a* is provided so as to penetrate a sliding sheet 522. The lubricant 60 is supplied from the plurality of openings 52*a* to the inner periphery of the fixing belt 53. Each of the plurality of openings 52*a* extends along a width direction of the fixing belt 53. The plurality of openings 52*a* is disposed side by side along a rotational direction of the fixing belt 53. The number of the openings 52*a* is not limited to a plural number, and may be a single number.

The channel sections 52*b* are provided to a block portion 521. The channel sections 52*b* are provided so as to extend in a thickness direction of the block portion 521. One end of each channel section 52*b* is connected to the opening 52*a* and the other end of each channel section 52*b* is connected to the gas introducing portion 52*c*1. The gas introducing portion 52*c*1 is provided to the block portion 521 positioned in a side close to the anchorage member 54D.

In such a configuration, gas is introduced from the gas supply source 72 through the pipe 59 into the gas introducing portion 52*c*1. The gas introduced into the gas introducing portion 52*c*1 passes through the channel sections 52*b* and is sent from the plurality of openings 52*a* toward the inner periphery of the fixing belt 53.

Accordingly, it is possible to remove foreign materials adhered to the inner periphery of the fixing belt 53 located between the pressing member 52D and a fixing roller. As described above, before supplying the lubricant 60 by the lubricant supply unit 55, the gas is delivered to the inner periphery of the fixing belt 53 so as to remove the foreign materials so that the lubricant 60 can be supplied more efficiently between the fixing belt 53 and the pressing member 52E.

As described above, even in the fixing device 50E and the image forming apparatus 100E according to the fifth embodiment, it is possible to obtain effects substantially similar to those obtained in the fixing device 50B and the image forming apparatus 100B according to the second embodiment.

In addition, as the gas can be delivered to the inner periphery of the fixing belt 53 from the openings 52*a* provided to the pressing member 52E, it is possible to remove the foreign materials adhered to the inner periphery of the fixing belt 53 as described above.

(Third Modification)

Figure 19:
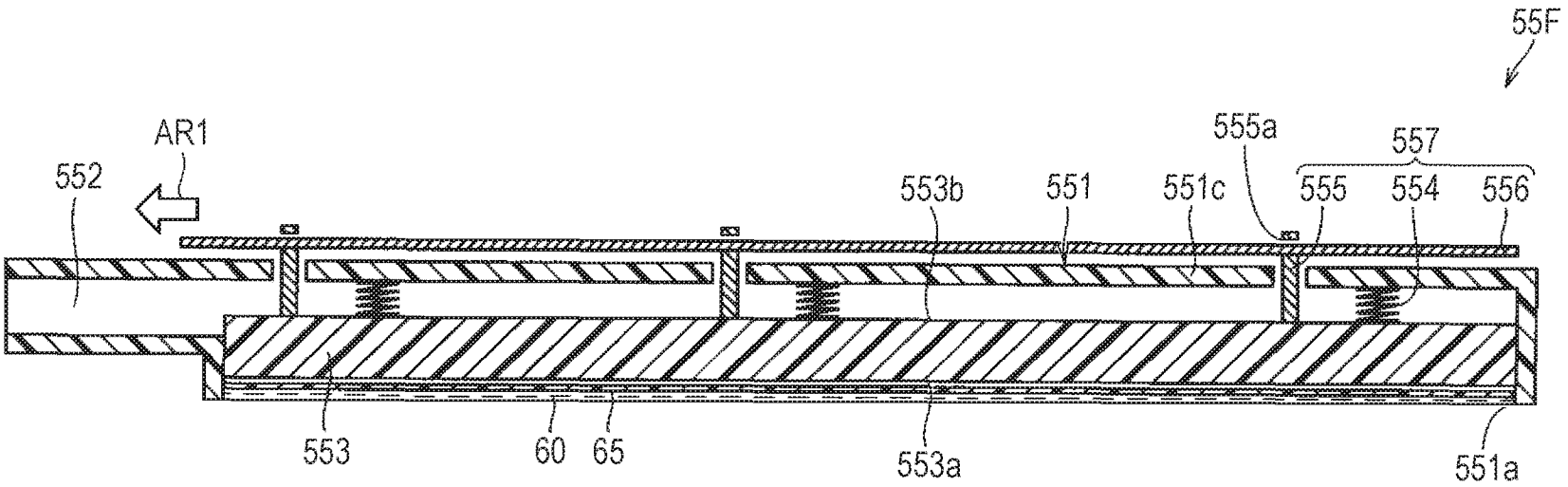
FIG. 19 is a cross sectional view of a lubricant supply unit according to a third modification.

FIG. 19 is a cross sectional view of a lubricant supply unit according to a third modification. With reference to FIG. 19, compared to the lubricant supply unit 55 according to the first embodiment, a lubricant supply unit 55F according to the third modification is different in that a stirring member 65 is provided.

The stirring member 65 has a rotary axis parallel to an extending direction in which an ejection port 551*a* extends. The stirring member 65 rotates around the rotary axis so as to stir a lubricant 60 held in a holding unit 551. The stirring member 65 is driven by a driving source (not shown) disposed inside a housing of an image forming apparatus.

As holding the lubricant 60 inside the holding unit 551 over a long period of time, lubricant components may be separated within the lubricant 60. Stirring the lubricant 60 with the stirring member 65 can make the components uniform.

Similar to the fixing device 50 and the image forming apparatus 100 according to the first embodiment, a fixing device and an image forming apparatus including the lubricant supply unit 55F can also moderate a lubricant to be supplied between a pressing member and a fixing belt, while holding a small amount of the lubricant.

The characteristic configurations described in the first to fifth embodiments and the first to third modifications may be appropriately combined without departing from the gist of the present invention. For example, the lubricating member supply unit according to the first to third modifications may be used in the fixing device according to the first to fifth embodiments.

Although the embodiments and modifications of the present invention have been described and illustrated in detail, it is clearly understood that the same is by way of illustrated and example only and is not to be taken by way of limitation, the scope of the present invention being interpreted by terms of the appended claims. The scope of the present invention involves any meanings equivalent to the claims and all modifications within the scope of the claims.

What is claimed is:

1. A fixing device comprising:

a fixing belt with no ends configured to be stretched and rotatable;

a heating unit configured to heat the fixing belt;

a fixing member disposed outside the fixing belt and configured to be in contact with the fixing belt by pressurizing;

a pressing member disposed inside the fixing belt and configured to press the fixing member with the fixing belt interposed between the pressing member and the fixing member; and a lubricant supply unit configured to supply a lubricant to an inner periphery of the fixing belt so as to supply the lubricant between the pressing member and the fixing belt, wherein the lubricant supply unit is disposed inside the fixing belt, configured to hold the lubricant, and includes a holding unit provided with a lubricant ejection port having a longitudinal shape and extending along a width direction of the fixing belt, wherein the lubricant supply unit includes a pushing member inside the holding unit in a side opposite to a side where the lubricant ejection port is located with respect to the lubricant, and the pushing member is configured to push out the lubricant from the lubricant ejection port.

2. The fixing device according to claim 1, wherein the holding unit is provided so as not to contact the fixing belt.

3. The fixing device according to claim 1, wherein in the width direction of the fixing belt, an amount of the lubricant to be ejected from a central part of the lubricant ejection port is larger than an amount of the lubricant to be ejected from both ends of the lubricant ejection port.

4. The fixing device according to claim 3, wherein in the width direction of the fixing belt, an opening area in the central part of the lubricant ejection port is larger than opening areas in both ends of the lubricant ejection port.

5. The fixing device according to claim 3, wherein:

in the width direction of the fixing belt, the lubricant ejection port has an opening area equal from one end to the other end of the lubricant ejection port, and the lubricant is held in the holding unit in such a manner that a height of the lubricant from an opening surface of the lubricant ejection port in a normal direction of the opening surface is higher in a central part than in both ends of the lubricant in the width direction of the fixing belt.

6. The fixing device according to claim 1, wherein:

the lubricant supply unit includes an external force application system for applying an external force to the pushing member in order to press the pushing member toward the lubricant ejection port, and the external force application system is stored inside the holding unit in a side opposite to a side where the lubricant is located with respect to the pushing member and includes a biasing unit for biasing the pushing member toward the lubricant ejection port.

7. The fixing device according to claim 6, wherein the external force application system further includes:

a supporting unit which is movable with respect to the holding unit and configured to support the pushing member against a biasing force of the biasing unit; and an engagement unit configured to disengageably engage with the supporting unit and to immobilize the supporting unit while engaging with the supporting unit, and wherein when the engagement unit is released from the supporting unit, the pushing member is moved together with the supporting unit toward the lubricant ejection port by the biasing force of the biasing unit.

8. The fixing device according to claim 1, wherein:

the pushing member has a first surface and a second surface opposing each other in a normal direction of an opening surface of the lubricant ejection port, the pushing member is movable by pressure of gas supplied into the holding unit, among the first and second surfaces of the pushing member, the first surface is disposed closer to the lubricant ejection port, and the second surface is disposed farther from the lubricant ejection port, the holding unit includes an introduction port into which the gas is introduced and an accumulation chamber configured to communicate with the introduction port and to accumulate the gas introduced from the introduction port, and the accumulation chamber is provided to a side opposite to a side where the lubricant is located with respect to the pushing member and has a bottom that includes the second surface.

9. The fixing device according to claim 8, wherein:

the lubricant supply unit further includes a pipe for introducing the gas to the introduction port, and the pipe includes one end connected to the introduction port and another end drawn out to outside and connected to a gas supply source.

10. The fixing device according to claim 8, wherein:

the first surface is provided with an impregnated member impregnated with the lubricant, and the impregnated member comes into contact with the inner periphery of the fixing belt after the pushing member moves toward the lubricant ejection port and pushes out the lubricant.

11. The fixing device according to claim 8, further comprising a decompressing device configured to decompress the accumulation chamber.

12. The fixing device according to claim 10, wherein the accumulation chamber is in a state of decompression before the lubricant is ejected from the lubricant ejection port.

13. The fixing device according to claim 1, wherein the pushing member has a cylindrical shape.

14. The fixing device according to claim 1, wherein the pushing member has flexibility.

15. The fixing device according to claim 1, wherein:

the holding unit is disposed at an upstream side of the pressing member in a rotational direction of the fixing belt, and rotation of the fixing belt supplies, between the fixing belt and the pressing member, the lubricant ejected from the lubricant ejection port to the inner periphery of the fixing belt.

16. The fixing device according to claim 1, wherein the pressing member includes:

at least one opening facing the inner periphery of the fixing belt;

a channel section communicating with the opening; and an introducing portion for introducing gas into the channel section, and wherein the gas introduced from the introducing portion passes through the channel section and is sent out from the opening.

17. The fixing device according to claim 1, wherein the lubricant supply unit has a rotary axis parallel to an extending direction in which the lubricant ejection port extends and includes a stirring member configured to stir the lubricant held inside the holding unit by rotating around the rotary axis.

18. An image forming apparatus comprising:

an image forming section configured to form a toner image on a recording medium conveyed along a conveyance channel; and the fixing device according to claim 1, which is configured to fix the toner image on the recording medium conveyed along the conveyance channel.

* * * * *